US011220965B2

(12) United States Patent
Martin et al.

(10) Patent No.: US 11,220,965 B2
(45) Date of Patent: Jan. 11, 2022

(54) METHOD AND SYSTEM FOR BALANCING CYLINDER AIR-FUEL RATIO

(71) Applicant: Ford Global Technologies, LLC, Dearborn, MI (US)

(72) Inventors: Douglas Raymond Martin, Canton, MI (US); Tyler Kelly, Plymouth, MI (US); John Eric Rollinger, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/540,006

(22) Filed: Aug. 13, 2019

(65) Prior Publication Data

US 2021/0047973 A1 Feb. 18, 2021

(51) Int. Cl.

| | |
|---|---|
| ***F02D 37/02*** | (2006.01) |
| ***F02D 21/04*** | (2006.01) |
| ***F02D 35/02*** | (2006.01) |
| ***F02D 33/00*** | (2006.01) |
| ***F02D 28/00*** | (2006.01) |
| *F02D 41/00* | (2006.01) |

(52) U.S. Cl.

CPC ..... *F02D 37/02* (2013.01); *F02D 21/04* (2013.01); *F02D 28/00* (2013.01); *F02D 33/006* (2013.01); *F02D 35/02* (2013.01); *F02D 41/008* (2013.01)

(58) Field of Classification Search

CPC ..... F02D 37/02; F02D 21/04; F02D 28/00; F02D 33/006; F02D 35/02; F02D 41/008

See application file for complete search history.

(56) References Cited

U.S. PATENT DOCUMENTS

| | | | | |
|---|---|---|---|---|
| 5,774,823 | A * | 6/1998 | James | G01M 15/11 123/406.24 |
| 6,148,808 | A * | 11/2000 | Kainz | F02D 41/0085 123/673 |
| 6,668,812 | B2 * | 12/2003 | Javaherian | F02D 41/0085 123/406.24 |
| 7,401,600 | B1 * | 7/2008 | Labus | F02M 25/08 123/520 |
| 7,802,563 | B2 | 9/2010 | Behr et al. | |
| 8,560,208 | B2 * | 10/2013 | Miyamoto | F02D 41/0065 701/103 |
| 8,682,569 | B2 * | 3/2014 | Bagnasco | F02D 41/0002 701/109 |

(Continued)

OTHER PUBLICATIONS

Kelly, T. et al., "Method and System for Cylinder Imbalance Detection," U.S. Appl. No. 16/405,939, filed May 7, 2019, 48 pages.

*Primary Examiner* — Phutthiwat Wongwian
*Assistant Examiner* — Susan E Scharpf
(74) *Attorney, Agent, or Firm* — Geoffrey Brumbaugh; McCoy Russell LLP

(57) ABSTRACT

Methods and systems are provided for detecting cylinder-to-cylinder air-fuel ratio (AFR) imbalance in engine cylinders. In one example, a method may include detecting an AFR imbalance of an engine cylinder based on an individual crankshaft acceleration of the cylinder relative to a mean crankshaft acceleration produced by all cylinders of the engine, and correcting a fuel amount of the cylinder via a fuel multiplier value, the fuel multiplier value selected from a plurality of fuel multiplier values based on an imbalance source. In this way, the AFR imbalance may be accurately detected and correcting using existing engine system sensors.

9 Claims, 8 Drawing Sheets

(56) References Cited

U.S. PATENT DOCUMENTS

| | | | | |
|---|---|---|---|---|
| 9,650,977 | B2 | 5/2017 | Martin et al. | |
| 9,752,517 | B2 * | 9/2017 | Rollinger | F02D 31/001 |
| 9,885,305 | B2 | 2/2018 | Jammoussi et al. | |
| 2007/0204838 | A1 * | 9/2007 | Leone | F02M 25/0827 123/518 |
| 2008/0060427 | A1 * | 3/2008 | Hoshi | F02D 41/221 73/114.04 |
| 2008/0178852 | A1 * | 7/2008 | Labus | F02M 25/08 123/520 |
| 2009/0171550 | A1 * | 7/2009 | Teraya | F02M 26/49 701/102 |
| 2009/0259382 | A1 * | 10/2009 | McKay | F02D 41/0085 701/102 |
| 2009/0281713 | A1 * | 11/2009 | Jankovic | F02D 41/1498 701/111 |
| 2011/0100327 | A1 * | 5/2011 | Nakagawa | F02D 41/0085 123/445 |
| 2011/0153181 | A1 * | 6/2011 | Bagnasco | F02D 13/0207 701/109 |
| 2012/0022772 | A1 * | 1/2012 | Miyamoto | F02D 41/0037 701/104 |
| 2012/0138017 | A1 * | 6/2012 | Jentz | F02D 41/0025 123/436 |
| 2012/0185156 | A1 * | 7/2012 | Iwazaki | F02D 41/0085 701/104 |
| 2013/0160750 | A1 * | 6/2013 | Maruyama | F02M 26/45 123/568.21 |
| 2013/0184969 | A1 * | 7/2013 | Rollinger | F02D 41/22 701/103 |
| 2014/0288802 | A1 | 9/2014 | Katayama et al. | |
| 2017/0356380 | A1 * | 12/2017 | Surnilla | F02D 41/123 |
| 2020/0271069 | A1 * | 8/2020 | Muto | F02D 41/2461 |

* cited by examiner

METHOD AND SYSTEM FOR BALANCING CYLINDER AIR-FUEL RATIO

FIELD

The present description relates generally to methods and systems for determining cylinder-to-cylinder torque imbalance in an internal combustion engine of a vehicle.

BACKGROUND/SUMMARY

Engine emissions compliance includes detection of air-fuel ratio (AFR) imbalances across engine cylinders. An AFR imbalance may occur when the AFR in one or more engine cylinders is different than the other engine cylinders. For example, cylinder AFR imbalances may occur due to variation in the size and shape of air passages coupled to each cylinder, intake manifold leakage, fuel flow variability of fuel injectors coupled to each cylinder, uneven exhaust gas recirculation distribution across cylinders, and uneven purge distribution across cylinders. In addition to degrading emissions, cylinder-to-cylinder AFR imbalances may result in torque disturbances that reduce engine performance and vehicle drivability.

One example approach for detecting cylinder-to-cylinder AFR imbalances is shown by Behr et al. in U.S. Pat. No. 7,802,563. Therein, an AFR imbalance is identified based on a response of a universal exhaust gas oxygen (UEGO) sensor at frequencies that are at or above a firing frequency of the cylinders during selected operating conditions. Specifically, when the engine is not operating under transient conditions, imbalance is identified if the integration of high frequency differential signals detected by the UEGO sensor is higher than a threshold. Still other approaches for AFR imbalance detection involve detecting AFR imbalance based on an exhaust manifold pressure estimated by a pressure sensor and/or individual cylinder torque outputs estimated by a crankshaft torque sensor.

However, the inventors herein have recognized potential issues with such systems. As one example, when using exhaust gas sensors as in the approach of Behr, there may be conditions where cylinder-to-cylinder AFR imbalance is not detected due to insufficient mixing of exhaust gas at the exhaust gas sensor. Further, the exhaust gas sensor may not be able to reliably detect cylinder-to-cylinder AFR imbalance during an engine cold-start condition due to insufficient warm-up of the exhaust gas sensor. As another example, when using exhaust manifold pressure to detect AFR imbalance, the detection may be affected by the distance between the pressure sensor and the cylinder. With increased distance, exhaust gas from other cylinders is more likely to mix with the exhaust gas from the cylinder being evaluated. As such, the reliability these approaches may vary based on operating conditions, and any resulting adjustments from the unreliable AFR imbalance detections may result in further AFR imbalances and torque disturbances. Additionally, individual cylinder torque measurements for AFR imbalance detection relies upon measurements from crankshaft torque sensors, which may not be included in every engine system.

In one example, the issues described above may be addressed by a method comprising indicating an air-fuel ratio (AFR) imbalance of a cylinder of a multi-cylinder engine based on a first crankshaft acceleration produced by the cylinder relative to a first mean crankshaft acceleration produced by all cylinders of the engine, and in response to the AFR imbalance, adjusting a fuel amount of the cylinder via a fuel multiplier, the fuel multiplier selected from a plurality of fuel multipliers based on an imbalance source. In this way, the AFR imbalance may be accurately identified non-intrusively using existing vehicle hardware and corrected via adjusting fueling to the imbalanced cylinder.

As one example, the imbalance source may include one or more imbalance sources, including one or more of nominal imbalance, exhaust gas recirculation (EGR) imbalance, and purge imbalance. For example, EGR imbalance may occur when EGR is provided due to uneven EGR distribution between cylinders, purge imbalance may occur when fuel vapors are purged from a fuel vapor storage canister due to uneven purge distribution between cylinders, and nominal imbalance may occur due to different sizes/shapes of air passages to each cylinder and/or fuel injector variation. Therefore, when more than one imbalance source is present, fuel multipliers associated with each imbalance source may be combined. Further, the crankshaft acceleration of each cylinder may be determined based on data received from a crankshaft position sensor during a calibrated window (e.g., a crank angle window).

As another example, the imbalanced cylinder may be assumed rich relative to the other cylinders of the engine responsive to the first crankshaft acceleration produced by the cylinder being at least a first threshold greater than the first mean crankshaft acceleration. Accordingly, the fuel multiplier may decrease the fuel amount of the imbalanced cylinder relative to the other cylinders. Conversely, the imbalanced cylinder may be assumed lean relative to the other cylinders of the engine responsive to the first crankshaft acceleration produced by the imbalanced cylinder being at least the first threshold less than the first mean crankshaft acceleration, and the fuel multiplier may increase the fuel amount of the imbalanced cylinder relative to the other cylinders by a corresponding amount.

As still another example, after adjusting the fuel amount of the imbalanced cylinder via the fuel multiplier, the crankshaft acceleration produced by each cylinder may be re-assessed. For example, a second crankshaft acceleration produced by the imbalanced cylinder may be compared to a second mean crankshaft acceleration produced by all cylinders of the engine, and responsive to the second crankshaft acceleration being greater than a second threshold from the second mean crankshaft acceleration, the fuel multiplier may be adjusted to further adjust the fuel amount of the imbalanced cylinder. Responsive to the second crankshaft acceleration being less than the second threshold from the second mean crankshaft acceleration, final balance adjustments may be made via spark timing adjustments. For example, the spark timing of the imbalanced cylinder may be advanced or retarded relative to the other cylinders in order to bring the acceleration of the imbalanced cylinder to the mean acceleration (e.g., within the first threshold from the mean acceleration), thereby mitigating the AFR imbalance.

By using existing engine sensors, such as the crankshaft position sensor, it is possible to identify one or more distinct engine cylinders with an AFR imbalance without adding cost or complexity of additional sensors. By comparing accelerations amongst cylinders, it is possible to determine cylinder AFR imbalances non-intrusively and with robust accuracy across engine operating conditions, including when EGR and purge are present. Additionally, such diagnostics may be carried out during cold start conditions prior to UEGO warm-up, and varying cylinder responses caused by distant measuring locations may be averted. By accurately identifying and correcting cylinder AFR imbalances, vehicle emissions may be reduced while engine smoothness may be increased, thereby increasing customer satisfaction.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
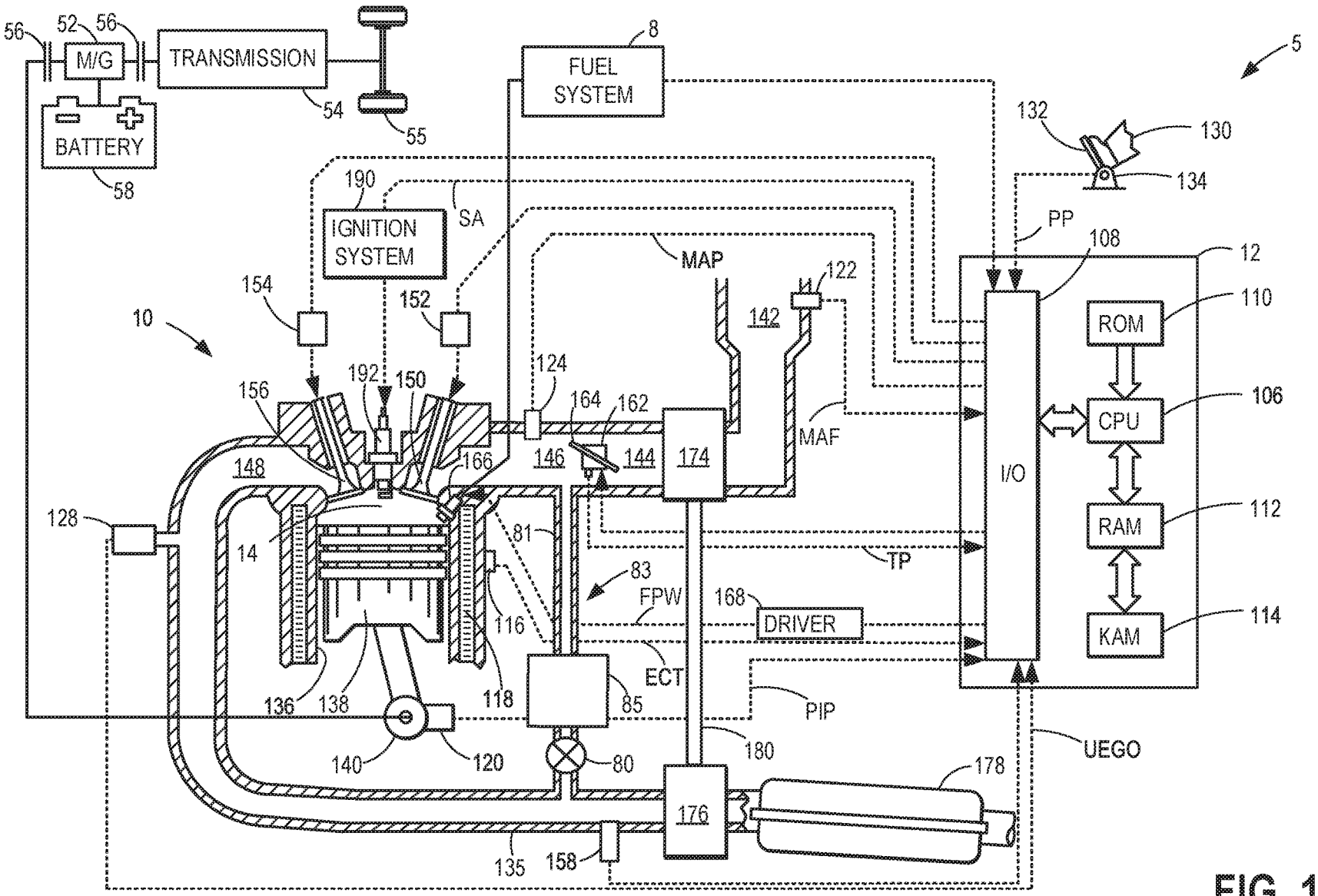
FIG. 1 shows a schematic depiction of a cylinder configuration in an engine system of a vehicle.
Figure 2:
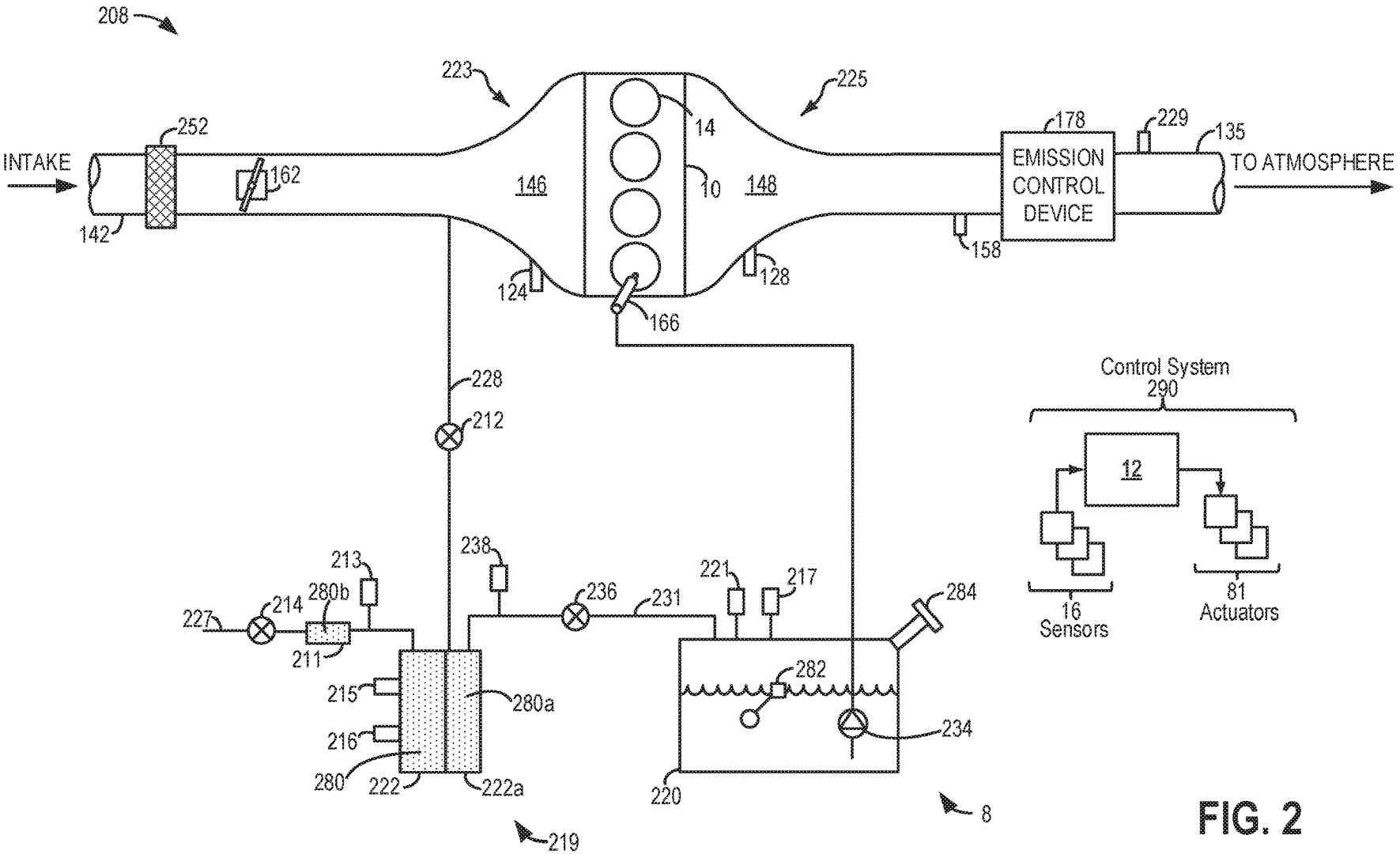
FIG. 2 shows a schematic depiction of a fuel system and evaporative emission system coupled to an engine system.
Figure 6:
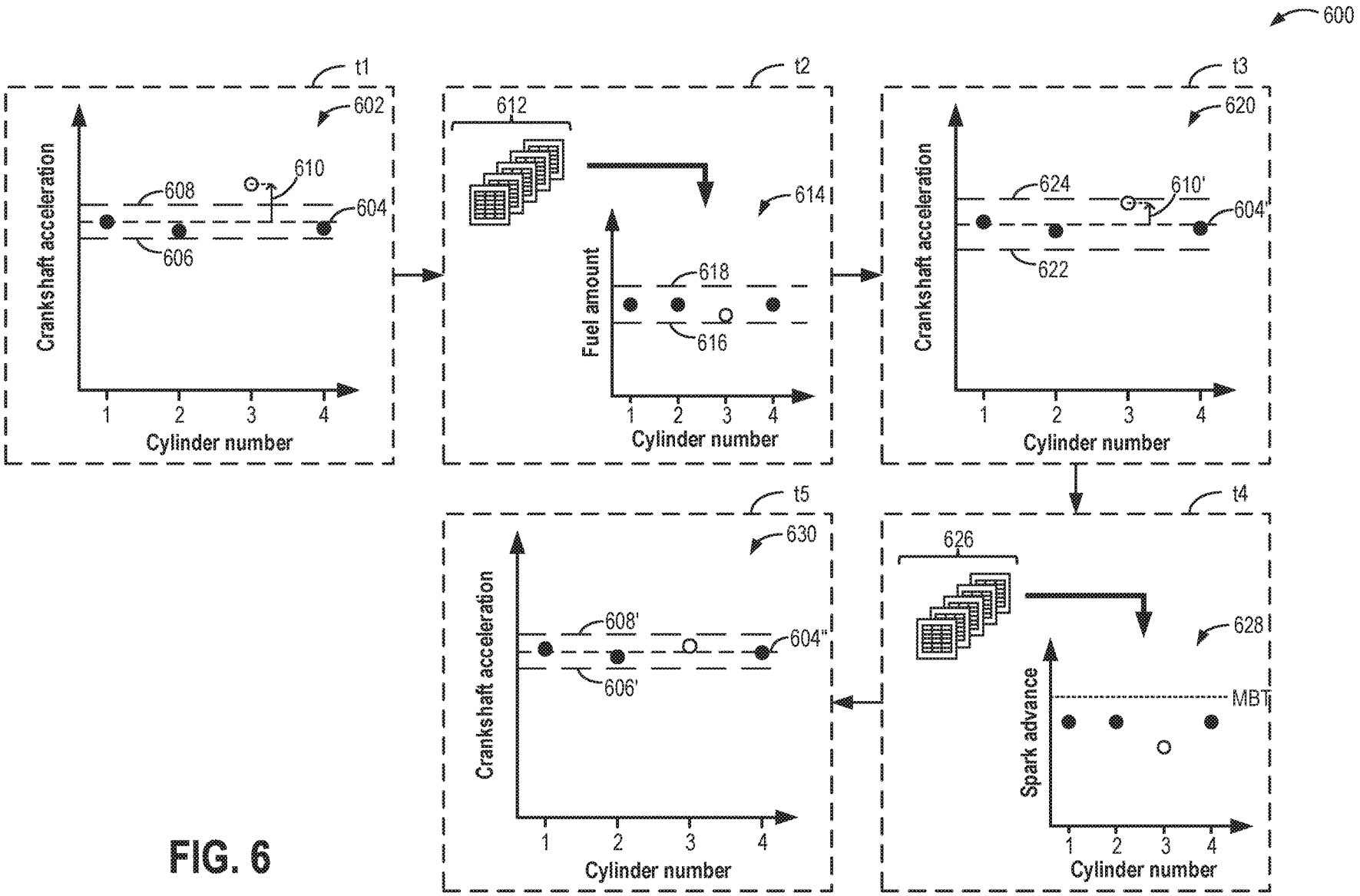
FIG. 6 shows a first example sequence for identifying and correcting a cylinder air-fuel ratio imbalance.
Figure 7:
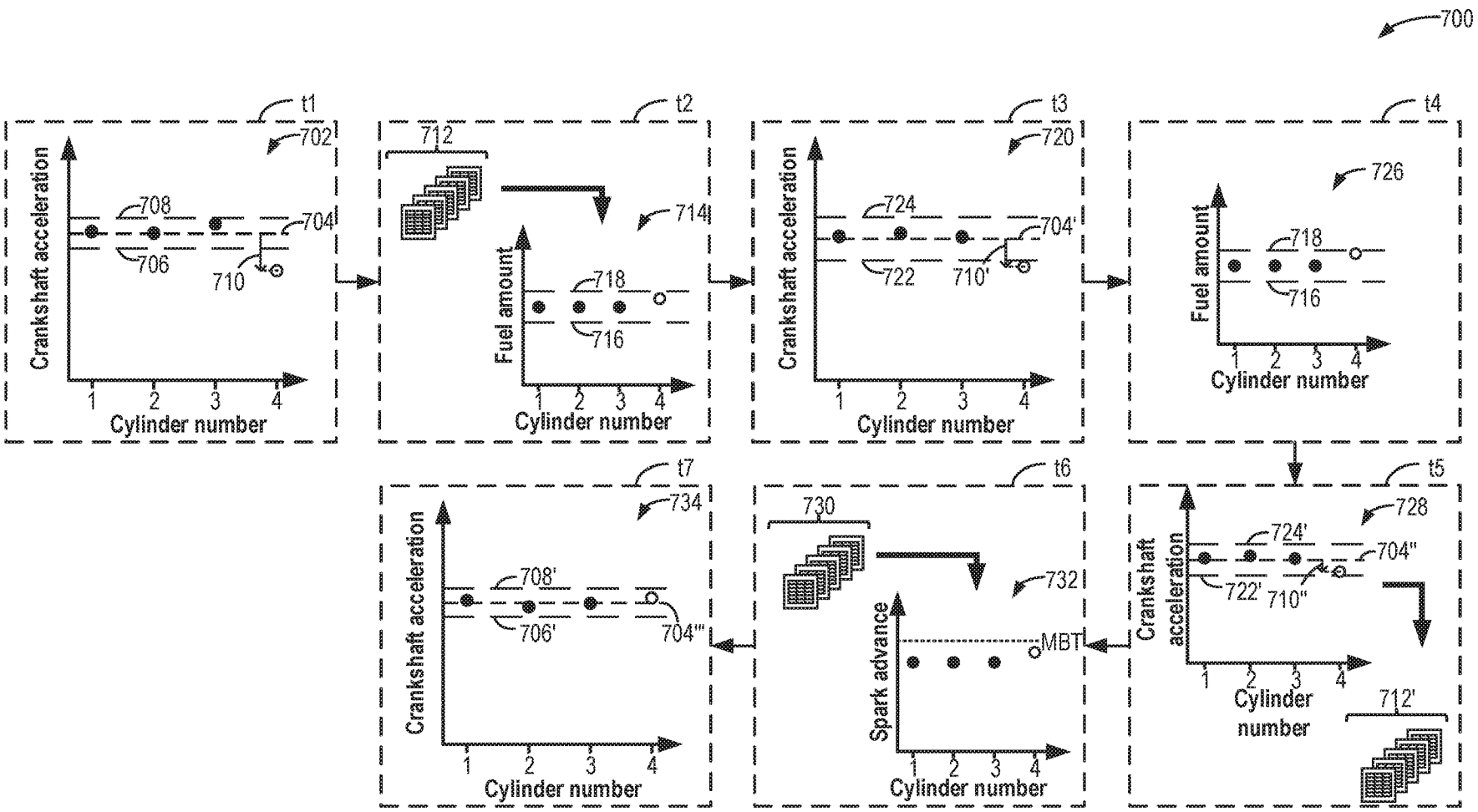
FIG. 7 shows a second example sequence for identifying and correcting a cylinder air-fuel ratio imbalance.

The following description relates to systems and methods for identifying a cylinder-to-cylinder imbalance in a vehicle using crankshaft acceleration and correcting the imbalance via stored arrays of fuel adjustments. As used herein, a cylinder-to-cylinder imbalance (also referred to as a cylinder air-fuel ratio imbalance or a cylinder imbalance) may be a difference in air-fuel ratio between cylinders that occurs when all engine cylinders are commanded to operate at a uniform air-fuel ratio. FIG. 1 shows a schematic depiction of one cylinder in a multi-cylinder engine further illustrated in FIG. 2. In particular, FIG. 1 depicts an example cylinder configuration of the one cylinder, which may receive external exhaust gas recirculation (EGR) from an EGR system, and FIG. 2 depicts a fuel system and an evaporative emissions system coupled to the multi-cylinder engine. A crankshaft position sensor coupled to a crankshaft of the engine may be utilized for sensing accelerations resulting from individual cylinder combustion events. For example, an engine controller may be configured to perform a control routine, such as the example routine of FIG. 4, to calibrate the crankshaft position sensor and generate acceleration windows for each cylinder during engine operation at different speed-load conditions, as shown in the example graphs of FIG. 5. The acceleration window may refer to tooth periods having a greatest velocity difference for each cylinder. The controller may use the calibrated acceleration windows along with crankshaft position sensor output to identify and correct cylinder AFR imbalances during vehicle operation, such as according to the example method of FIGS. 3A-3B. Two example sequences for identifying and correcting a cylinder AFR imbalance are shown in FIGS. 6-7.

FIG. 1 schematically shows an example cylinder 14 of an internal combustion engine 10, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 via a transmission 54, as will be further described below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected to vehicle wheels 55 via transmission 54 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners including as a parallel, a series, or a series-parallel hybrid vehicle. In electric vehicle embodiments, a system battery 58 may be a traction battery that delivers electrical power to electric machine 52 to provide torque to vehicle wheels 55. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator.

Cylinder 14 of engine 10 can receive intake air via a series of intake air passages 142, and 144 and an intake manifold 146. Intake manifold 146 can communicate with other cylinders of engine 10 in addition to cylinder 14. In some examples, one or more of the intake passages may include a boosting device, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. In some examples, exhaust turbine 176 may be a variable geometry turbine (VGT) where turbine geometry is actively varied by actuating turbine vanes as a function of engine speed and other operating conditions. In one example, the turbine vanes may be coupled to an annular ring, and the ring may be rotated to adjust a position of the turbine vanes. In another example, one or more of the turbine vanes may be pivoted individually or pivoted in plurality. As an example, adjusting the position of the turbine vanes may adjust a cross sectional opening (or area)

of exhaust turbine 176. However, in other examples, such as when engine 10 is provided with a supercharger, compressor 174 may be powered by mechanical input from a motor or the engine, and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174. A throttle position sensor may be provided to measure a position of throttle plate 164.

An exhaust manifold 148 can receive exhaust gases from other cylinders of engine 10 in addition to cylinder 14. An exhaust gas sensor 128 is shown coupled to exhaust manifold 148 upstream of an emission control device 178. Exhaust gas sensor 128 may be selected from among various suitable sensors for providing an indication of an exhaust gas air/fuel ratio (AFR), such as a linear oxygen sensor or UEGO (universal or wide-range exhaust gas oxygen, as depicted), a two-state oxygen sensor or EGO, a HEGO (heated EGO), a NOx sensor, a HC sensor, or a CO sensor, for example. Emission control device 178 may be a three-way catalyst, a NOx trap, various other emission control devices, or combinations thereof. As one example, emission control device 178 is a three-way catalyst that is maximally active at an AFR of stoichiometry. Herein, the AFR will be discussed as a relative AFR, defined as a ratio of an actual AFR of a given mixture to stoichiometry and represented by lambda ($\lambda$). A lambda value of 1 occurs during stoichiometric operation (e.g., at stoichiometry), wherein the air-fuel mixture produces a complete combustion reaction. A rich feed ($\lambda<1$) results from air-fuel mixtures with more fuel (or less air) relative to stoichiometry, whereas a lean feed ($\lambda>1$) results from air-fuel mixtures with less fuel (or more air) relative to stoichiometry.

External exhaust gas recirculation (EGR) may be provided to the engine via a high pressure EGR system 83. EGR system 83 delivers exhaust gas from a zone of higher pressure in exhaust passage 148, upstream of turbine 176, to a zone of lower pressure in intake manifold 146, downstream of compressor 174 and throttle 162, via an EGR passage 81. An amount EGR provided to intake manifold 146 may be varied by controller 12 via an EGR valve 80. For example, controller 12 may be configured to actuate and adjust a position of EGR valve 80 to adjust the amount of exhaust gas flowing through EGR passage 81. EGR valve 80 may be adjusted between a fully closed position, in which exhaust gas flow through EGR passage 81 is blocked, and a fully open position, in which exhaust gas flow through the EGR passage is enabled. As an example, EGR valve 80 may be continuously variable between the fully closed position and the fully open position. As such, the controller may increase a degree of opening of EGR valve 80 to increase an amount of EGR provided to intake manifold 146 and decrease the degree of opening of EGR valve 80 to decrease the amount of EGR provided to intake manifold 146. As an example, EGR valve 80 may be an electronically activated solenoid valve. In other examples, EGR valve 80 may be positioned by an incorporated stepper motor, which may be actuated by controller 12 to adjust the position of EGR valve 80 through a range of discreet steps (e.g., 52 steps), or EGR valve 80 may be another type of flow control valve.

Under some conditions, the EGR system may be used to regulate the temperature of the air and fuel mixture within the combustion chamber. Further, EGR may be desired to attain a desired engine dilution, thereby improving fuel efficiency and emissions quality, such as emissions of nitrogen oxides. As an example, EGR may be requested at low-to-mid engine loads. Thus, it may be desirable to measure or estimate the EGR mass flow. EGR sensors may be arranged within EGR passage 81 and may provide an indication of one or more of mass flow, pressure, and temperature of the exhaust gas, for example. Additionally, EGR may be desired after emission control device 178 has attained its light-off temperature. An amount of EGR requested may be based on engine operating conditions, including engine load (as estimated via pedal position sensor 134), engine speed (as estimated via a crankshaft acceleration sensor, which will be further described below), engine temperature (as estimated via an engine coolant temperature sensor 116), etc. For example, controller 12 may refer to a look-up table having the engine speed and load as the input and output a desired amount of EGR corresponding to the input engine speed-load. In another example, controller 12 may determine the desired amount of EGR (e.g., desired EGR flow rate) through logic rules that directly take into account parameters such as engine load, engine speed, engine temperature, etc. In still other examples, controller 12 may rely on a model that correlates a change in engine load with a change in a dilution requirement, and further correlates the change in the dilution requirement with a change in the amount of EGR requested. For example, as the engine load increases from a low load to a mid load, the amount of EGR requested may increase, and then as the engine load increases from a mid load to a high load, the amount of EGR requested may decrease. Controller 12 may further determine the amount of EGR requested by taking into account a best fuel economy mapping for a desired dilution rate. After determining the amount of EGR requested, controller 12 may refer to a look-up table having the requested amount of EGR as the input and a signal corresponding to a degree of opening to apply to the EGR valve (e.g., as sent to the stepper motor or other valve actuation device) as the output.

EGR may be cooled via passing through EGR cooler 85 within EGR passage 81. EGR cooler 85 may reject heat from the EGR gases to engine coolant, for example. Although FIG. 2 shows EGR valve 80 positioned in EGR passage 81 upstream of EGR cooler 85, in other examples, EGR valve 80 may be positioned downstream of EGR cooler 85. Further, although EGR system 83 is a high pressure EGR system in the example illustrated in FIG. 2, in other examples, EGR system 83 may be a mid-pressure or a low pressure EGR system. For example, EGR system 83 may be a low pressure EGR system, wherein EGR passage 81 is coupled to exhaust passage 148 downstream of turbine 176 and is coupled to intake air passage 142 upstream of compressor 174. Thus, the configuration of EGR system 83 shown in FIG. 2 is non-limiting and provided by way of example.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of variable intake cam timing, variable exhaust cam timing, dual independent variable cam timing, or fixed cam timing may be used. When can actuation is used, each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples, such as where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at or near maximum brake torque (MBT) timing to maximize engine power and efficiency. Controller 12 may input engine operating conditions, including engine speed and engine load, into a look-up table and output the corresponding MBT timing for the input engine operating conditions, for example.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to the pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12. The fuel system will be further described below with respect to FIG. 2.

In an alternate example, fuel injector 166 may be arranged in an intake port rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and further configured to inject this fuel mixture directly into cylinder 14. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol contents, different water contents, different octane numbers, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of ethanol and water, a mixture of water and methanol, a mixture of alcohols, etc. In still another example, both fuels may be alcohol blends with varying alcohol compositions, wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities, such as a difference in temperature, viscosity, octane number, etc. In still another example, fuel tanks in fuel system 8 may hold diesel fuel. Moreover, fuel characteristics of one or both fuel tanks may vary frequently, for example, due to day to day variations in tank refilling.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including the signals previously discussed and additionally including a measurement of inducted mass air flow (MAF) from a mass air flow sensor 122; an engine coolant temperature (ECT)

from temperature sensor 116 coupled to a cooling sleeve 118; an exhaust gas temperature from a temperature sensor 158 coupled to exhaust passage 148 upstream of turbine 176; a profile ignition pickup signal (PIP) from a crankshaft position sensor 120 coupled to crankshaft 140; throttle position (TP) from the throttle position sensor; signal UEGO from exhaust gas sensor 128, which may be used by controller 12 to determine the AFR of the exhaust gas; and an absolute manifold pressure signal (MAP) from a MAP sensor 124. The manifold pressure signal MAP from MAP sensor 124 may be used to provide an indication of vacuum or pressure in the intake manifold, and controller 12 may infer an engine temperature based on the engine coolant temperature.

An engine speed signal, RPM, may be generated by controller 12 from signal PIP. For example, the crankshaft position sensor 120 (also referred to herein as a crankshaft acceleration sensor) may be a Hall effect sensor (or other type) that is positioned so that teeth on a reluctor ring attached to the crankshaft pass close to a sensor tip. The reluctor ring may have one or more teeth missing to provide the controller with a reference point to the crankshaft 140 position. As an example, the reluctor ring may include 60 teeth with two missing teeth. As crankshaft 140 rotates, crankshaft position sensor 120 may produce a pulsed voltage signal, where each pulse corresponds to a tooth on the reluctor ring.

Controller 12 receives signals from the various sensors of FIG. 1 and employs the various actuators of FIG. 1 to adjust engine operation based on the received signals and instructions stored on a memory of the controller. As will be elaborated herein with respect to FIG. 3, acceleration of each cylinder of engine 10 may be estimated by controller 12 based on input from crankshaft position sensor 120. Further, as will be described with respect to FIGS. 3A-3B, controller 12 may use the estimated acceleration of each cylinder of engine 10 to determine cylinder AFR imbalances. For example, controller 12 may detect an AFR imbalance in response to a sensed cylinder acceleration being lower than a mean acceleration of all of the cylinders of engine 10, resulting from the cylinder operating leaner than commanded. As another example, controller 12 may detect an AFR imbalance in response to a sensed cylinder acceleration being higher than a mean acceleration of all of the cylinders of engine 10, resulting from the cylinder operating richer than commanded. Controller 12 may adjust fueling to the imbalanced cylinder responsive to the AFR imbalance by adjusting a pulse width of signal FPW transmitted to the corresponding fuel injector 166, for example.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Continuing to FIG. 2 a schematic depiction of vehicle 5 having an engine system 208 is shown. Components described with reference to FIG. 2 that have the same identification labels as components described with reference to FIG. 1 are the same components and may operate as previously described. Further, some components introduced in FIG. 1 are not shown in FIG. 2, although it may be understood that such components may be included in engine system 208 (e.g., EGR system 83, turbine 176, etc.).

Engine system 208 includes engine 10 having a plurality of cylinders 14. Although four cylinders 14 are shown in FIG. 2, engine 10 may include any suitable number of cylinders. Engine 10 includes an intake system 223 and an exhaust system 225. Intake system 223 is shown including throttle 162 fluidly coupled to intake manifold 146 via intake air passage 142. Air may be routed to throttle 162 after passing through an air filter 252 coupled to intake passage 142 upstream of throttle 162. Exhaust system 225 includes exhaust manifold 148 leading to exhaust passage 135 that routes exhaust gas to the atmosphere via emission control device 178.

Engine system 208 is coupled to fuel system 8 and an evaporative emissions system 219. Fuel system 8 includes a fuel tank 220 coupled to a fuel pump 234, the fuel tank supplying fuel to engine 10 that propels vehicle 5. Evaporative emissions system 219 includes a fuel vapor storage canister 222. During a fuel tank refueling event, fuel may be pumped into the vehicle from an external source through a refueling port 284. Fuel tank 220 may hold a plurality of fuel blends, including fuel with a range of alcohol concentrations, such as various gasoline-ethanol blends, including E10, E85, gasoline, etc., and combinations thereof, as further described above with respect to FIG. 1. A fuel level sensor 282 located in fuel tank 220 may provide an indication of a fuel level ("Fuel Level Input") to controller 12, which may be included in a control system 290. As depicted, fuel level sensor 282 may comprise a float connected to a variable resistor. Alternatively, other types of fuel level sensors may be used.

Fuel pump 234 is configured to deliver pressurized fuel to fuel injectors of engine 10. While only a single fuel injector 166 is shown, additional fuel injectors may be provided for each cylinder. It will be appreciated that fuel system 8 may be a return-less fuel system, a return fuel system, or various other types of fuel system. Further, fuel system 8 may include more than one fuel pump.

Vapors generated in fuel tank 220 may be routed to fuel vapor storage canister 222 via a conduit 231 for storage before being purged to the intake system 223. Fuel vapor storage canister 222 is filled with an appropriate adsorbent 280 for temporarily trapping fuel vapors (including vaporized hydrocarbons) generated during fuel tank refueling operations, diurnal vapors, and running-loss vapors. In one example, adsorbent 280 is activated charcoal (e.g., carbon). While a single fuel vapor storage canister 222 is shown, it will be appreciated that fuel system 8 and evaporative emissions system 219 may include any number of fuel vapor storage canisters. When purging conditions are met, such as when the fuel vapor storage canister is saturated, vapors stored in fuel vapor storage canister 222 may be purged to intake system 223 by opening a canister purge valve (CPV) 212 positioned in a purge line 228. In one example, canister purge valve 212 may be a solenoid valve wherein opening or closing of the valve is performed via actuation of a canister purge solenoid. As an example, CPV 212 may be a normally closed solenoid-actuated valve wherein CPV 212 is fully closed when de-energized to block (e.g., prevent) flow through purge line 228 and wherein CPV 212 is at least partially open when energized to enable flow through purge line 228.

Fuel vapor storage canister 222 may include a buffer 222*a* (or buffer region), each of the fuel vapor storage canister and the buffer comprising adsorbent. For example, buffer 222*a* is shown packed with an adsorbent 280*a*. As shown, the volume of buffer 222*a* may be smaller than (e.g., a fraction of) the volume of fuel vapor storage canister 222. Adsorbent

280*a* in the buffer 222*a* may be the same as or different from adsorbent 280 in the fuel vapor storage canister (e.g., both may include charcoal). Buffer 222*a* may be positioned within fuel vapor storage canister 222 such that during fuel vapor storage canister loading, fuel tank vapors are first adsorbed within the buffer, and then when the buffer is saturated, further fuel tank vapors are adsorbed in the fuel vapor storage canister. In comparison, during fuel vapor storage canister purging, fuel vapors are first desorbed from the fuel vapor storage canister (e.g., to a threshold amount) before being desorbed from the buffer. In other words, loading and unloading of the buffer is not linear with the loading and unloading of the fuel vapor storage canister. As such, the effect of the fuel vapor storage canister buffer is to dampen any fuel vapor spikes flowing from the fuel tank to the fuel vapor storage canister, thereby reducing the possibility of any fuel vapor spikes going to the engine.

Fuel vapor storage canister 222 includes a vent 227 for routing gases out of the fuel vapor storage canister 222 to the atmosphere when storing fuel vapors from fuel tank 220. Vent 227 may also allow fresh air to be drawn into fuel vapor storage canister 222 when purging stored fuel vapors to engine intake 223 via purge line 228 and canister purge valve 212. While this example shows vent 227 communicating with fresh, unheated air, various modifications may also be used. Vent 227 may include a canister vent valve (CVV) 214 to adjust a flow of air and vapors between fuel vapor storage canister 222 and the atmosphere. When included, CVV 214 may be a normally open valve so that air, stripped of fuel vapor after having passed through the fuel vapor storage canister, can be pushed out to the atmosphere (for example, during refueling while the engine is off). Likewise, during purging operations (for example, during fuel vapor storage canister regeneration and while the engine is running), the fuel vapor storage canister vent valve may be opened to allow a flow of fresh air to strip the fuel vapors stored in the fuel vapor storage canister. In one example, canister vent valve 214 may be a solenoid valve wherein opening or closing of the valve is performed via actuation of a canister vent solenoid. In particular, CVV 214 may be a normally open solenoid-activated valve that is (e.g., fully) open when de-energized, allowing gas to flow between the atmosphere and evaporative emissions system 219 via vent 227, and fully closed when energized to block gas flow through vent 227.

Evaporative emissions system 219 may further include a bleed fuel vapor storage canister 211. Hydrocarbons that desorb from fuel vapor storage canister 222 (hereinafter also referred to as the "main fuel vapor storage canister") may be adsorbed within the bleed fuel vapor storage canister. Bleed fuel vapor storage canister 211 may include an adsorbent material 280*b* that is different than the adsorbent material included in main fuel vapor storage canister 222. Alternatively, the adsorbent material 280*b* in bleed fuel vapor storage canister 211 may be the same as that included in main fuel vapor storage canister 222.

A hydrocarbon (HC) sensor 213 may be present in evaporative emissions system 219 to indicate the concentration of hydrocarbons in vent 227. As illustrated, hydrocarbon sensor 213 is positioned between main fuel vapor storage canister 222 and bleed fuel vapor storage canister 211. A probe (e.g., sensing element) of hydrocarbon sensor 213 is exposed to and senses the hydrocarbon concentration of gas flow in vent 227. Hydrocarbon sensor 213 may be used by the engine control system 290 for determining breakthrough of hydrocarbon vapors from main fuel vapor storage canister 222, in one example.

One or more temperature sensors 215 may be coupled to and/or within fuel vapor storage canister 222. As fuel vapor is adsorbed by the adsorbent in the fuel vapor storage canister, heat is generated (heat of adsorption). Likewise, as fuel vapor is desorbed by the adsorbent in the fuel vapor storage canister, heat is consumed. In this way, the adsorption and desorption of fuel vapor by the fuel vapor storage canister may be monitored and estimated based on temperature changes within the fuel vapor storage canister. Further, one or more canister heating elements 216 may be coupled to and/or within fuel vapor storage canister 222. Canister heating element 216 may be used to selectively heat the fuel vapor storage canister (and the adsorbent contained within) for example, to increase desorption of fuel vapors prior to performing a purge operation. Canister heating element 216 may comprise an electric heating element, such as a conductive metal, ceramic, or carbon element that may be heated electrically. In some embodiments, canister heating element 216 may comprise a source of microwave energy or may comprise a fuel vapor storage canister jacket coupled to a source of hot air or hot water. Canister heating element 216 may be coupled to one or more heat exchangers that may facilitate the transfer of heat, (e.g., from hot exhaust) to fuel vapor storage canister 222. Canister heating element 216 may be configured to heat air within fuel vapor storage canister 222 and/or to directly heat the adsorbent located within fuel vapor storage canister 222. In some embodiments, canister heating element 216 may be included in a heater compartment coupled to the interior or exterior of fuel vapor storage canister 222. In some embodiments, fuel vapor storage canister 222 may be coupled to one or more cooling circuits, and/or cooling fans. In this way, fuel vapor storage canister 222 may be selectively cooled to increase adsorption of fuel vapors (e.g., prior to a refueling event). In some examples, canister heating element 216 may comprise one or more Peltier elements, which may be configured to selectively heat or cool fuel vapor storage canister 222.

In some examples, a fuel tank isolation valve (FTIV) 236 may be optionally included in conduit 231 such that fuel tank 220 is coupled to fuel vapor storage canister 222 via the valve. During regular engine operation, FTIV 236 may be kept closed to limit the amount of diurnal or "running loss" vapors directed to fuel vapor storage canister 222 from fuel tank 220. During refueling operations and selected purging conditions, FTIV 236 may be temporarily opened, e.g., for a duration, to direct fuel vapors from fuel tank 220 to fuel vapor storage canister 222. By opening the valve during purging conditions or when the fuel tank pressure is higher than a threshold (e.g., above a mechanical pressure limit of the fuel tank), the refueling vapors may be released into the fuel vapor storage canister and the fuel tank pressure may be maintained below pressure limits. While the depicted example shows FTIV 236 positioned along conduit 231, in alternative examples, the isolation valve may be mounted on fuel tank 220.

One or more pressure sensors may be coupled to fuel system 8 and evaporative emissions system 219 for providing an estimate of a fuel system and an evaporative emissions system pressure, respectively. In the example illustrated in FIG. 2, a first pressure sensor 217 is coupled directly to fuel tank 220, and a second pressure sensor 238 is coupled to conduit 231 between FTIV 236 and fuel vapor storage canister 222. For example, first pressure sensor 217 may be a fuel tank pressure transducer (FTPT) coupled to fuel tank 220 for measuring a pressure of fuel system 8, and second pressure sensor 238 may measure a pressure of evaporative emissions system 219. In alternative examples, first pressure sensor 217 may be coupled between fuel tank 220 and fuel vapor storage canister 222, specifically between the fuel tank and FTIV 236. In still other examples, a single pressure sensor may be included for measuring both the fuel system pressure and the evaporative system pressure, such as when FTIV 236 is open or omitted.

One or more temperature sensors 221 may also be coupled to fuel system 8 for providing an estimate of a fuel system temperature. In one example, the fuel system temperature is a fuel tank temperature, wherein temperature sensor 221 is a fuel tank temperature sensor coupled to fuel tank 220. While the depicted example shows temperature sensor 221 directly coupled to fuel tank 220, in other examples, the temperature sensor may be coupled between the fuel tank and fuel vapor storage canister 222.

Fuel vapors released from fuel vapor storage canister 222, such as during a purging operation, may be directed into intake manifold 146 via purge line 228. The flow of vapors along purge line 228 may be regulated by canister purge valve 212, coupled between the fuel vapor storage canister and the engine intake. The quantity and rate of vapors released by the fuel vapor storage canister purge valve may be determined by a duty cycle of activation of an associated canister purge valve solenoid (not shown). As such, the duty cycle of the canister purge valve solenoid may be determined by controller 12 responsive to engine operating conditions, including, for example, engine speed-load conditions, an air-fuel ratio, a fuel vapor storage canister load, etc. By commanding the canister purge valve to be closed, the controller may seal the fuel vapor recovery system from the engine intake. An optional canister check valve (not shown) may be included in purge line 228 to prevent intake manifold pressure from flowing gases in the opposite direction of the purge flow. As such, the check valve may be beneficial if the canister purge valve control is not accurately timed or the canister purge valve itself can be forced open by a high intake manifold pressure. An estimate of the manifold absolute pressure or manifold vacuum may be obtained by controller 12 from MAP sensor 124 coupled to intake manifold 146. Alternatively, MAP may be inferred from alternate engine operating conditions, such as a mass air flow measured by MAF sensor 122 of FIG. 1.

Fuel system 8 and evaporative emissions system 219 may be operated by controller 12 in a plurality of modes by selective adjustment of the various valves and solenoids. For example, the fuel system and evaporative emissions system may be operated in a refueling mode (e.g., when fuel tank refueling is requested by a vehicle operator), wherein the controller 12 may open FTIV 236 and canister vent valve 214 while maintaining canister purge valve 212 closed to depressurize the fuel tank before enabling fuel to be added therein. As such, FTIV 236 may be kept open during the refueling operation to allow refueling vapors to be stored in the fuel vapor storage canister. After refueling is completed, FTIV 236 may be closed. By maintaining canister purge valve 212 closed, refueling vapors are directed into fuel vapor storage canister 222 while preventing the fuel vapors from flowing to intake manifold 146. As another example, the fuel system and the evaporative emissions system may be operated in a fuel vapor storage canister purging mode (e.g., after an emission control device light-off temperature has been attained and with the engine running), wherein the controller 12 may open canister purge valve 212 and open (or maintain open) canister vent valve 214 while closing (or maintaining closed) FTIV 236. The vacuum generated by intake manifold 146 may be used to draw fresh air through vent 227 and through fuel vapor storage canister 222 to purge the stored fuel vapors into intake manifold 146 via purge line 228. In this mode, the purged fuel vapors from fuel vapor storage canister 222 are combusted in engine 10. The purging may be continued until the stored fuel vapor amount in fuel vapor storage canister 222 is below a threshold, for example.

During purging, the learned vapor amount/concentration may be used to determine the amount of fuel vapors stored in the fuel vapor storage canister, and then during a later portion of the purging operation (when the fuel vapor storage canister is sufficiently purged or empty), the learned vapor amount/concentration may be used to estimate a loading state of fuel vapor storage canister 222. For example, one or more oxygen sensors (not shown) may be coupled to fuel vapor storage canister 222 (e.g., downstream of the fuel vapor storage canister) or positioned in the engine intake and/or engine exhaust to provide an estimate of a fuel vapor storage canister load (that is, an amount of fuel vapors stored in the fuel vapor storage canister). Based on the fuel vapor storage canister load and further based on engine operating conditions, such as engine speed-load conditions, a purge flow rate may be determined.

Vehicle 5 may further include control system 290. Control system 290 is shown receiving information from a plurality of sensors 16 (various examples of which are described herein) and sending control signals to a plurality of actuators 81 (various examples of which are described herein). As one example, sensors 16 may include exhaust gas sensor 128, a temperature sensor 158 coupled to exhaust passage 135 upstream of emission control device 178, MAP sensor 124, FTPT 217, second pressure sensor 238, hydrocarbon sensor 213, temperature sensor 221, and a pressure sensor 229 located downstream of emission control device 178. Other sensors, such as additional pressure, temperature, air/fuel ratio, and composition sensors, may be coupled to various locations in the vehicle 5. As another example, actuators 81 may include fuel injector 166, FTIV 236, purge valve 212, vent valve 214, fuel pump 234, and throttle 162.

Together, the systems of FIGS. 1 and 2 provide a multi-cylinder engine system that may include both an EGR system for recirculating a portion of exhaust gas and an evaporative emissions system for storing and then purging fuel vapors. As one example, a controller (e.g., controller 12 of FIGS. 1-2) may adjust engine fueling based on engine air flow, EGR rate, purge flow rate, etc. in order to achieve a desired (e.g., commanded) AFR (e.g., stoichiometry). As mentioned above, an emission control device (e.g., emission control device 178 of FIGS. 1-2) may be most efficient when the engine operates at stoichiometry, and therefore, the commanded AFR may be kept at or near stoichiometry during most operating conditions. However, variations in the size and shape of air passages, variability in fuel injector flow from cylinder to cylinder, EGR distribution across cylinders, and purge flow distribution across cylinders may result in the AFR to vary across cylinders. For example, the EGR distribution and the purge flow distribution may not be uniform between the engine cylinders. As an illustrative example, a first cylinder may be positioned closer to where an intake manifold of the engine is coupled to a purge line (e.g., a purge inlet) than a second cylinder, and so the first cylinder may receive a greater proportion of the purge flow than the second cylinder. In contrast, the second cylinder may be positioned closer to where the intake manifold is coupled to an EGR passage (e.g., an EGR inlet) than the first cylinder, and so the second cylinder may receive a greater proportion of the EGR than the first cylinder.

When the AFR imbalance exceeds a threshold, the emission control device may no longer operate at stoichiometry, resulting in an increase in vehicle emissions. Further, the AFR imbalance may result in torque disturbances, for example, due to different burn rates of rich mixtures, lean mixtures, and stoichiometric mixtures. Further, global closed-loop fuel control of the engine (or engine bank) via feedback from an exhaust gas sensor (e.g., exhaust gas sensor 128 of FIGS. 1-2) may not identify cylinder-to-cylinder AFR imbalances, as the exhaust gas sensor may be positioned to measure a mixture of exhaust gas from all of the cylinders of the engine (or the engine bank).

Figure 3A:
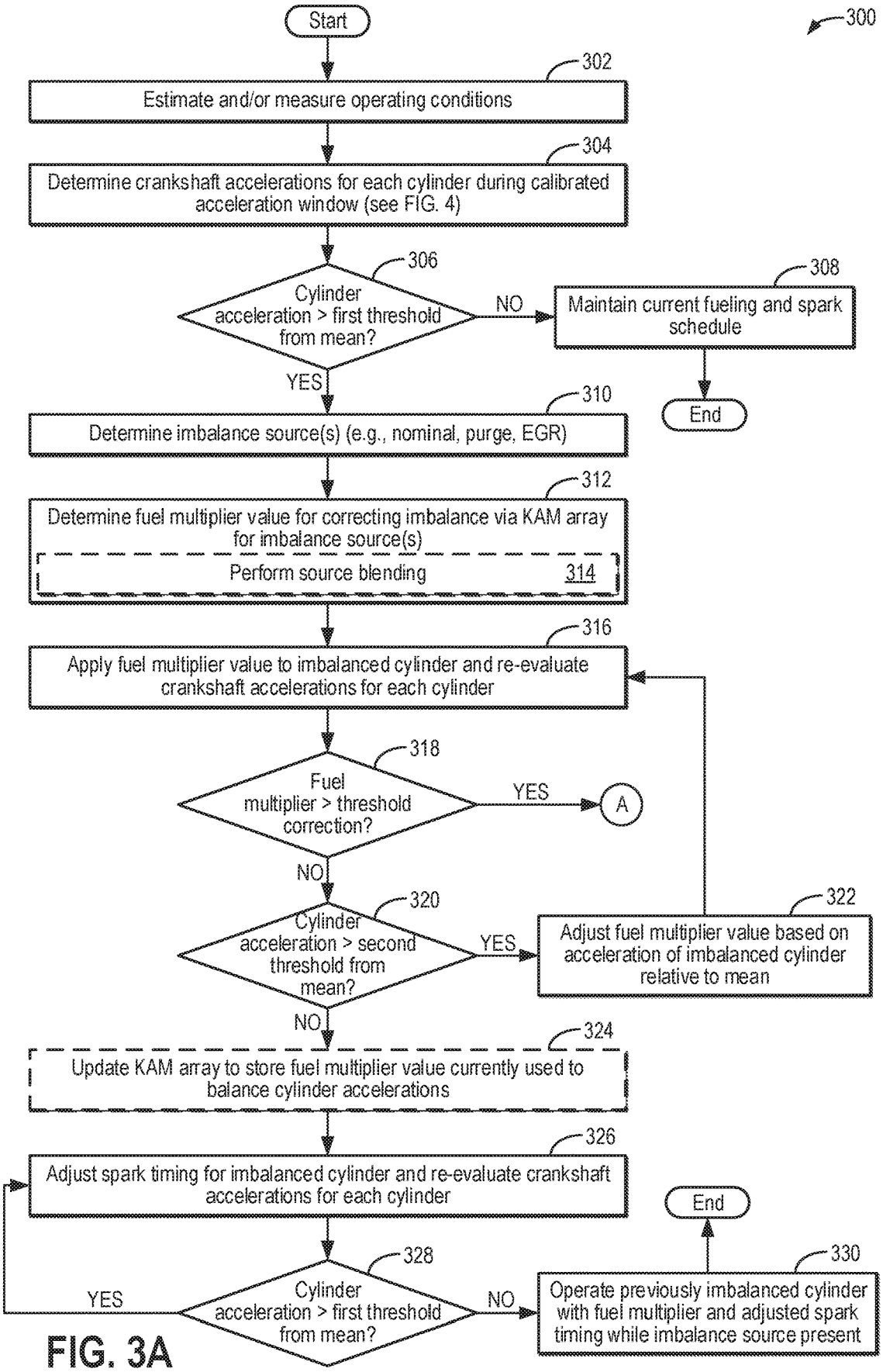
FIGS. 3A-3B show an example method for identifying and correcting cylinder-to-cylinder air-fuel ratio imbalances.
Figure 3B:
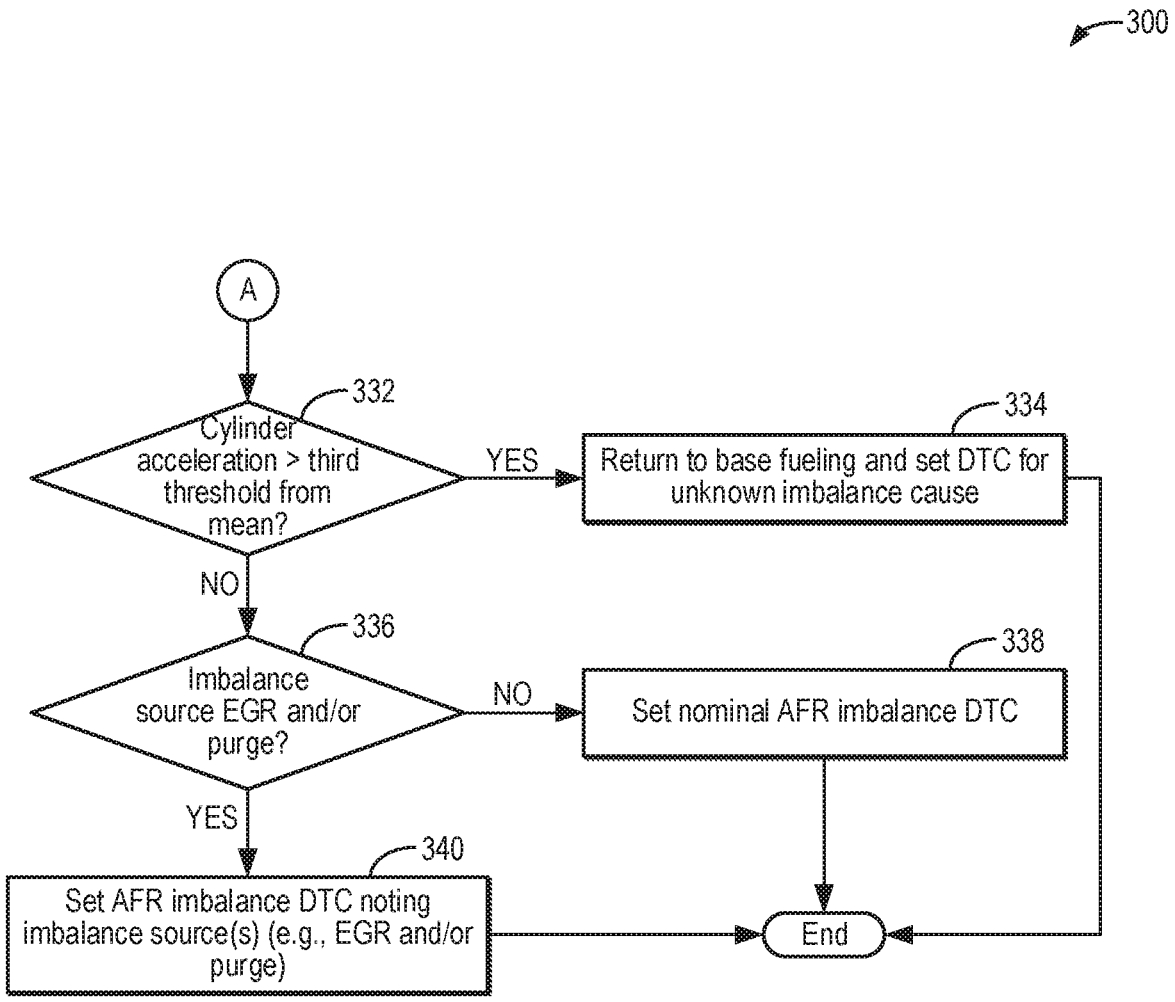

Therefore, FIGS. 3A and 3B provide an example method 300 for identifying and correcting cylinder AFR imbalances. Thus, method 300 may provide both an AFR imbalance monitor and an AFR imbalance correction. Instructions for carrying out method 300 and the rest of the methods included herein may be executed by a controller (e.g., controller 12 of FIGS. 1-2) based on instructions stored on a memory of the controller and in conjunction with signals received from sensors of the engine system, such as the sensors described above with reference to FIGS. 1-2 (e.g., crankshaft position sensor 120 of FIG. 1). The controller may employ engine actuators of the engine system to adjust engine operation according to the methods described below.

At 302, method 300 includes estimating and/or measuring operating conditions. The operating conditions may include, for example, vehicle speed, engine speed, engine load, MAP, accelerator pedal position (e.g., torque demand), a commanded AFR, an EGR flow rate, and a purge flow rate. Additional operating conditions may include ambient conditions, such as ambient temperature, ambient pressure, and ambient humidity. As one example, the EGR flow rate may be zero when EGR is not provided (e.g., an EGR valve, such as EGR valve 80 shown in FIG. 1, is fully closed). Conversely, the EGR flow rate may be non-zero when EGR is provided (e.g., the EGR valve is at least partially open). Similarly, the purge flow rate may be zero when purge is not provided (e.g., a purge valve, such as CPV 212 shown in FIG. 2, is fully closed). Likewise, the purge flow rate may be non-zero when purge is provided (e.g., the purge valve is at least partially open).

At 304, method 300 includes determining crankshaft accelerations for each cylinder during a calibrated acceleration window. For example, as will be elaborated below with respect to FIG. 4, a calibration may be performed over a range of engine operating conditions, including a range of engine speeds and loads, to determine a tooth period for each cylinder that has a highest velocity difference, thereby enabling an accurate acceleration determination for each individual cylinder's combustion reaction. Further, after determining the crankshaft accelerations for each individual cylinder, the method at 304 may further include determining a mean (e.g., average) crankshaft acceleration for all cylinders of the engine for the engine cycle. For example, the average crankshaft acceleration may be determined by summing together the crankshaft accelerations for teach individual cylinder and dividing the sum by the number of cylinders.

In some examples, the individual crankshaft accelerations produced by each cylinder may not be determined if transient engine conditions, such as tip-ins and tip-outs, are detected (e.g., based on the accelerator pedal position). In a further example, AFR imbalance monitoring (via determining the individual crankshaft accelerations produced by each cylinder) may be carried out when the engine is being operated at a stoichiometric AFR.

At 306, method 300 includes determining if any individual cylinder acceleration is greater than a first threshold from the mean acceleration. For example, the first threshold may be a first pre-calibrated, non-zero percentage of the mean. As another example, the controller may use the first threshold to define a first threshold range around the mean acceleration, outside of which the individual cylinder acceleration may be determined to be greater than the first threshold from the mean and inside of which the individual cylinder acceleration may be considered to be approximately equivalent to the mean. Therefore, the cylinder acceleration may be greater than the first threshold from the mean acceleration when the cylinder acceleration is at least the first threshold more than the mean acceleration or at least the first threshold less than the mean acceleration. As one non-limiting example, the first threshold may be 0.2% of the mean. Further, a cylinder producing lower than the mean acceleration may be assumed to be lean, whereas a cylinder producing higher than the mean acceleration may be assumed to be rich.

If no individual cylinder acceleration is greater than the first threshold from the mean (e.g., all individual cylinder accelerations fall within the first threshold from the mean), method 300 proceeds to 308 and includes maintaining a current fueling and spark schedule. Because all of the cylinder accelerations are within the threshold from the mean, the controller may infer that cylinder AFR imbalances are not present. Without a cylinder AFR imbalance, fueling and spark may not be adjusted to counteract the imbalance. However, engine fueling and spark timing may continue to be adjusted responsive to changing engine operating conditions, such as a change in torque demand, MAP, etc. Method 300 may then end.

Returning to 306, if instead a cylinder acceleration of one or more cylinders is greater than the threshold from the mean, method 300 proceeds to 310 and includes determining imbalance source(s) that may be causing the cylinder AFR imbalance(s). The imbalance source(s) may be determined from a plurality of potential imbalance sources, including nominal, EGR, and purge. The nominal imbalance source may refer to cylinder AFR imbalances that occur during nominal engine operation due to differences in air passages supplying air to each cylinder and/or due to fuel injector flow variances. The EGR imbalance source may refer to cylinder AFR imbalances that occur due to differences in EGR distribution across cylinders when EGR is provided, such as due to a closer proximity of one cylinder to an EGR inlet, for example. The purge imbalance source may refer to cylinder AFR imbalances that occur due to differences in purge distribution across cylinders when stored fuel vapors are purged from a fuel vapor storage canister to an engine intake, such as due to a closer proximity of one cylinder to a purge line, for example. Thus, each of the plurality of imbalance sources include one or more intake flow sources (e.g., fresh air for the nominal imbalance source, a mixture of fresh air and EGR for the EGR imbalance source, and a mixture of fresh air a fuel vapors for the purge imbalance source), and the controller may determine the presence or absence of each intake flow source when determining which imbalance source is present.

As a first example, when EGR and purge are not provided, the nominal imbalance source may be determined. As a second example, when EGR is provided (e.g., the EGR valve is at least partially open) and fuel vapor canister purging is not occurring (e.g., the canister purge valve is maintained fully closed), EGR may be determined as the imbalance source. As a third example, when purge is occurring (e.g., the canister purge valve is at least partially open) and EGR is not provided (e.g., the EGR valve is fully closed), purge may be may be determined as the imbalance source. As a fourth example, when both EGR and purge are being provided to the engine intake, both EGR imbalance and purge imbalance may be determined as potential imbalance sources.

At 312, method 300 includes determining a fuel multiplier value for correcting the imbalance using a KAM array for the determined imbalance source(s). For example, one or more arrays of fuel multiplier values may be stored in keep alive memory (e.g., KAM 114 of FIG. 1) for each imbalance source. As an example, the controller may include separate KAM arrays for nominal imbalance conditions, EGR imbalance conditions, and purge imbalance conditions. Further, the controller may store a separate KAM array for each imbalance source for each individual cylinder, at least in some examples. Each KAM array may include pre-calibrated fuel multiplier values that may be further updated once balancing is achieved, as will be further described below with respect to 324. Each fuel multiplier value may adjust the fueling of the imbalanced cylinder without adjusting base fueling to the entire engine (which may be determined via closed-loop control using separate closed-loop fuel KAM arrays and feedback from the exhaust gas sensor, for example). Further, the fuel multiplier values may be mean-centered about 1.0. As one example, a fuel multiplier value of 1.0 would produce the base fueling (e.g., no adjustment). As another example, a fuel multiplier value less than 1.0 would decrease the fueling from the base fueling, whereas a fuel multiplier value greater than 1.0 would increase the fueling from the base fueling.

As an example, the controller may input a percentage difference of the imbalanced cylinder acceleration from the mean acceleration, including a direction of the difference (e.g., positive or negative), and engine operating conditions (e.g., engine speed and load) into the KAM array for the corresponding imbalance source (and cylinder number), which may output the corresponding fuel multiplier value that is predicted to correct the cylinder imbalance. As an example, as the percentage difference increases, a magnitude of the fuel correction (e.g., difference from the base fueling) may increase.

When applicable, such as where there is more than one potential imbalance source (e.g., both EGR and purge are provided), determining the fuel multiplier value further includes performing source blending, as optionally indicated at 314. That is, in examples where more than one imbalance source has been determined, the controller may input the percentage difference into the KAM array for each imbalance source, resulting in more than one fuel multiplier value being determined (e.g., one from the purge KAM array, one from the EGR KAM array). The controller may then blend the fuel multiplier value output from each array in proportion to a percentage of a max flow that is occurring for each imbalance source. Further, it may be understood that if multiple imbalanced cylinders are detected (e.g., at 306), the controller may determine a separate fuel multiplier value for each cylinder. Thus, the controller may combine learned corrections for a plurality of imbalance sources when the engine is operating with the plurality of imbalance sources together (e.g., both purge and EGR).

At 316, method 300 includes applying the determined fuel multiplier value to the imbalanced cylinder and re-evaluating the crankshaft accelerations for each cylinder. For example, the base fueling amount determined via closed-loop control may be multiplied by the determined fuel multiplier value to determine a fueling amount to provide to the imbalanced cylinder. As mentioned above, this may include decreasing the fuel amount when the imbalanced cylinder is presumed rich (e.g., the crankshaft acceleration produced by the cylinder is at least the threshold amount greater than the mean acceleration at 306) and increasing the fuel amount when the imbalanced cylinder is presumed lean (e.g., the crankshaft acceleration produced by the cylinder is at least the threshold amount less than the mean acceleration at 306). The controller may then adjust a control signal sent to the fuel injector of the imbalanced cylinder, such as a pulse width of the signal, through a determination that directly takes into account the product of the base fuel amount and the fuel multiplier, such as increasing the pulse width as the product (e.g., the determined fuel amount for the imbalanced cylinder) increases. The controller may alternatively determine the pulse width using a look-up table by inputting the determined amount of fuel for the imbalanced cylinder (e.g., determined using the base fuel amount and the fuel multiplier) into the look-up table, which may output the pulse width.

Each cylinder of the engine, including the imbalanced cylinder (or cylinders), may be fueled by actuating its fuel injector at an appropriate time in the engine cycle to provide fuel for combustion. The crankshaft acceleration produced by the combustion event for each individual cylinder may be again determined as described above at 304. Further, the cylinder crankshaft accelerations may be evaluated after operating the engine with the corrected fueling for a threshold duration. The threshold duration may be a non-zero time duration that enables engine operation to stabilize and achieve a relatively constant speed (e.g., 3 engine cycles). By re-evaluating the crankshaft accelerations for each cylinder after applying the fuel multiplier value determined at 312 to the imbalanced cylinder, the controller may determine whether adjusting the imbalanced cylinder's fueling corrected the imbalance (e.g., balanced the cylinders), as will be elaborated below with respect to 320.

At 318, method 300 includes determining if the fuel multiplier value produces greater than a threshold correction. The threshold correction may be a pre-calibrated, threshold percentage fuel correction, for example. As one example, the threshold correction may be 20%. The controller may determine that the fuel multiplier value produces greater than the threshold correction responsive to the fuel multiplier decreasing the imbalanced cylinder's fueling by more than 20% or increasing the imbalanced cylinder's fueling by more than 20% from the base fuel amount. In such an example, fuel multiplier values of greater than 1.2 and less than 0.8 may correspond to fuel multiplier values producing greater than the threshold correction. As an example, when the fuel multiplier value produces a relatively high fuel correction (e.g., greater than the threshold correction), degradation may be present. Thus, the threshold correction may separate cylinder imbalances caused by variations in air, fuel, purge, and EGR flow from imbalances caused by degradation.

If the fuel multiplier value does not produce greater than the threshold correction, method 300 proceeds to 320 and includes determining if any individual cylinder acceleration is greater than a second threshold from the mean acceleration. For example, the second threshold may be a second pre-calibrated, non-zero percentage of the mean. As another example, the controller may use the second threshold to define a second threshold range around the mean acceleration, outside of which the individual cylinder acceleration may be determined to be greater than the second threshold from the mean. Therefore, the cylinder acceleration may be greater than the second threshold from the mean acceleration when the cylinder acceleration is at least the second threshold more than the mean acceleration or at least the second threshold less than the mean acceleration. In some examples, the second threshold may be greater than the first threshold defined above at 306. For example, fuel adjustments may be used to bring the imbalanced cylinder closer to the mean acceleration, but spark timing may also be adjusted for final balancing, as will be further described below with respect to 326. As one non-limiting example, the second threshold may be 1% of the mean. However, in other examples, the second threshold may be less than or equal to the first threshold.

If one or more cylinder produces a crankshaft acceleration greater than the second threshold from the mean (e.g., the cylinder accelerations are not all within the second threshold from the mean acceleration), method 300 proceeds to 322 and includes adjusting the fuel multiplier value based on the acceleration of the imbalanced cylinder relative to the mean. For example, even though the fuel multiplier KAM arrays are calibrated to correct for cylinder AFR imbalances across a range of operating conditions, in some examples, the given values may not result in cylinder balancing. As an illustrative example, fuel injector flow may change over time due to wear and/or degradation, and so fuel multiplier values that previously resulted in cylinder balancing may no longer be effective.

Adjusting the fuel multiplier value based on the acceleration of the imbalanced cylinder relative to the mean may include, for example, further increasing the fuel multiplier (e.g. further increasing the fuel multiplier value above 1.0) responsive to the imbalanced cylinder remaining lean (e.g., the cylinder acceleration is at least the second threshold amount less than the mean acceleration) and further decreasing the fuel multiplier (e.g., further decreasing the fuel multiplier value below 1.0) responsive to the imbalanced cylinder remaining rich (e.g., the cylinder acceleration is at least the second threshold amount more than the mean acceleration). In one example, the controller may adjust the fuel multiplier value in proportion to the difference between the acceleration produced by the imbalanced cylinder and the mean acceleration. In another example, the controller may input a change in the difference achieved via the current fuel multiplier value into a look-up table, algorithm, or map, which may output a corresponding adjustment to the fuel multiplier value. In still another example, the controller may make a logical determination (e.g., regarding the adjustment to the fuel multiplier value) based on logic rules that are a function of the difference and/or the change in the difference. Method 300 may then return to 316 to apply the adjusted fuel multiplier value to the imbalanced cylinder and re-evaluate the crankshaft accelerations for each cylinder. In this way, the fueling of the imbalanced cylinder may be changed iteratively responsive to the AFR imbalance remaining.

Returning to 320, if no cylinder acceleration is greater than the second threshold from the mean (e.g., the cylinder accelerations are all within the second threshold from the mean acceleration), at 324, method 300 optionally includes updating the KAM array to store the fuel multiplier value currently used to balance the cylinder accelerations. For example, if the fuel multiplier value was adjusted (e.g., at 322) from the previously stored value, the updated value may be saved in the KAM array so that an accuracy of the fuel multiplier value may be increased. As one example, the controller may save the fuel multiplier value in the KAM array for the corresponding cylinder and the corresponding imbalance source and may further index the fuel multiplier value against the current operating conditions. However, if the previously stored fuel multiplier value results in the cylinder accelerations all being within the second threshold, method 300 may proceed directly to 326, and 324 may be omitted.

At 326, method 300 includes adjusting spark timing for the imbalanced cylinder and re-evaluating crankshaft accelerations for each cylinder. Adjusting the spark timing may include advancing or retarding the spark timing relative to a currently scheduled timing. This may include, for example, retarding the spark timing of the imbalanced cylinder (e.g., further retarding from MBT timing to decrease torque) when the individual acceleration of the imbalanced cylinder is at least the second threshold more than the mean acceleration and advancing the spark timing of the imbalanced cylinder (e.g., further advancing toward MBT timing to increase torque) when the individual acceleration of the imbalanced cylinder is at least the second threshold less than the mean acceleration. In one example, the controller may adjust the spark timing in proportion to the difference between the acceleration produced by the imbalanced cylinder and the mean acceleration. In another example, the controller may input the difference between the acceleration produced by the imbalanced cylinder and the mean acceleration into a look-up table, algorithm, or map, which may output a corresponding adjustment to the spark timing. In still another example, the controller may make a logical determination (e.g., regarding the adjustment to the spark timing) based on logic rules that are a function of the difference. The controller may then actuate the spark plug of the imbalanced cylinder at the adjusted timing (e.g., via signal SA) and re-evaluate the crankshaft accelerations for each cylinder.

At 328, method 300 includes determining if any individual cylinder acceleration is greater than the first threshold from the mean acceleration, as defined above at 306. If the acceleration of one or more cylinder remains greater than the first threshold from the mean, method 300 returns to 326 to continue adjusting the spark timing. In this way, the spark timing may be incrementally adjusted to balance the engine. If no individual cylinder acceleration is greater than the first threshold from the mean acceleration, method 300 proceeds to 330 and includes operating the previously imbalanced cylinder with the determined fuel multiplier and the adjusted spark timing while imbalance source remains present. That is, the cylinder AFR imbalance may be corrected via a combination of fuel and spark adjustments so that all of the engine cylinders produce a uniform crankshaft acceleration during nominal conditions, EGR, and/or purge. As one example, when the imbalance source is nominal (e.g., EGR and purge are not provided), the cylinder previously determined to be imbalanced (e.g., at 306) may be operated with the adjusted fueling and spark timing (e.g., compared with the other cylinders) across all nominal conditions. As another example, when the imbalance source is EGR, the cylinder previously determined to be imbalanced may be operated with the adjusted fueling and spark timing during conditions when EGR is provided and not during conditions when EGR is not provided. By identifying the cylinder AFR imbalance, correcting the imbalance, and continuing to correct the imbalance while the imbalance source remains present, vehicle emissions may be decreased while engine smoothness is increased, thereby increasing customer satisfaction. Method 300 may then end.

Further, method 300 may be repeated so that the cylinder balance may be re-evaluated as operating conditions change, and the relevant fuel multiplier values and spark timings may be updated, as applicable. Additionally, in some examples where both EGR and purge are present, the controller may distinguish between AFR imbalances caused by purge distribution and those caused by EGR distribution by re-evaluating the cylinder AFR imbalance when only one of EGR and purge is flowing. For example, the controller may isolate the cylinder imbalance sources to independently learn the imbalance correction for each of the sources (e.g., by updating the corresponding KAM array once balance is achieved, as described above at 324). By isolating the imbalance sources to independently learn the corresponding cylinder imbalance correction, an accuracy of the fuel correction may be increased, even while multiple imbalance sources are present.

Returning to 318, if the fuel multiplier value produces greater than the threshold correction, method 300 proceeds to 332 and includes determining if the cylinder acceleration of the imbalanced cylinder(s) is greater than a third threshold from the mean acceleration. For example, the third threshold may be a third pre-calibrated, non-zero percentage of the mean. As another example, the controller may use the third threshold to define a third threshold range around the mean acceleration, outside of which the individual cylinder acceleration may be determined to be greater than the third threshold from the mean. Therefore, the cylinder acceleration may be greater than the third threshold from the mean acceleration when the cylinder acceleration is at least the third threshold more than the mean acceleration or at least the third threshold less than the mean acceleration. The third threshold may be greater than each of the first threshold (defined at 306) and the second threshold (defined at 320). As one non-limiting example, the third threshold may be 3% of the mean.

If the acceleration produced by the combustion event of the imbalanced cylinder is greater than the third threshold even after the fueling has been adjusted by greater than the threshold correction, then it may be assumed that the imbalance is not an AFR imbalance and may be caused by other sources (e.g., misfire). Therefore, method 300 may proceed to 334 and includes returning to base fueling and setting a diagnostic trouble code (DTC) for an unknown imbalance cause. The unknown imbalance DTC may also be specific to the cylinder with the detected imbalance, for example. By returning to base fueling, additional emissions degradation may be reduced or avoided. For example, because the fuel multiplier has not produced cylinder balancing, the fuel multiplier may instead cause an AFR imbalance. Further, the controller may illuminate a malfunction indicator lamp (MIL) to alert the driver to service the vehicle so that the imbalance cause can be identified and repaired. Method 300 may then end.

Returning to 332, if the acceleration of the imbalanced cylinder is not greater than the third threshold from the mean (e.g., all of the cylinders are within the third threshold range), method 300 proceeds to 336 and includes determining if the imbalance source is EGR and/or purge. For example, the controller may use the determination made at 310 to decide which DTC to set. If EGR and purge are not being provided (e.g., the nominal imbalance source is present), method 300 proceeds to 338 and includes setting a nominal AFR imbalance DTC. The nominal AFR imbalance DTC may also be specific to the cylinder(s) with the detected imbalance, for example. Further, the controller may illuminate the MIL to alert the driver to service the vehicle. By setting the nominal AFR imbalance DTC, a repair technician may more easily identify degraded vehicle components that are causing the imbalance. Method 300 may then end.

Returning to 336, if the imbalance source includes EGR and/or purge, method 300 proceeds to 340 and includes setting an AFR imbalance DTC noting the (non-nominal) imbalance source(s). For example, if EGR is present and purge is not, the controller may set an EGR AFR imbalance DTC. As another example, if purge is present and EGR is not, the controller may set a purge AFR imbalance DTC. As still another example, if both purge and EGR are present, the controller may set an EGR and purge AFR imbalance DTC. Further, in some examples where both EGR and purge are present, the controller may distinguish between AFR imbalances caused by purge distribution and those caused by EGR distribution by re-evaluating the cylinder AFR imbalance when only one of EGR and purge is flowing. The AFR imbalance DTC may also be specific to the cylinder(s) having the detected imbalance, for example. Further, the controller may illuminate the MIL to alert the driver to service the vehicle. By setting the non-nominal AFR imbalance DTC and noting the imbalance source(s), a repair technician may more rapidly identify degraded vehicle components that are causing the imbalance. Method 300 may then end.

In this way, method 300 of FIGS. 3A-3B provides a method for accurately detecting cylinder-to-cylinder AFR imbalances using existing vehicle hardware, even while non-nominal imbalance sources (e.g., EGR and purge) are present. By using the mean crankshaft acceleration produced by all of the engine cylinders instead of absolute values, changes that affect the entire engine, such as increased friction or changes in fuel type, will not trigger AFR imbalances detection. Further, the AFR imbalances may be corrected in real-time using crankshaft acceleration as feedback until the engine is balanced. Furthermore, by correcting fueling via the fuel multiplier values to correct the imbalance, the most likely source of the imbalance (e.g., differences in AFRs between cylinders) is addressed while spark may then be used to fine-tune the cylinder-to-cylinder balance. Engine smoothness may be increased by balancing the engine, thereby increasing vehicle occupant satisfaction.

Figure 4:
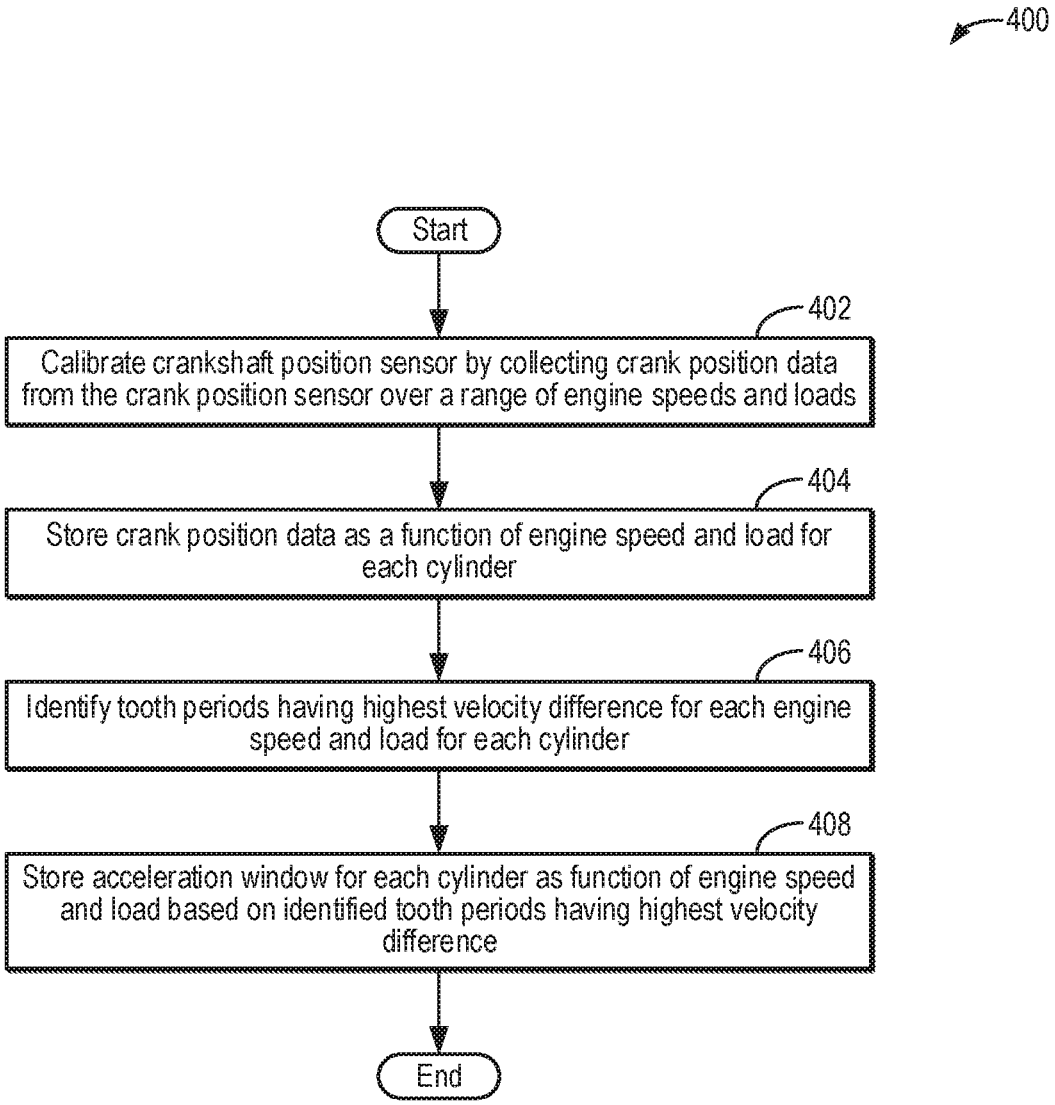
FIG. 4 shows an example method for calibrating a crankshaft position sensor and subsequent generation of cylinder calibration profiles.

Next, FIG. 4 shows an example method 400 for calibrating a crankshaft position sensor for determining tooth periods for calculating a crankshaft acceleration produced by each individual cylinder of the engine. As one example, method 400 may be executed by a controller (e.g., controller 12 of FIGS. 1 and 2) during vehicle calibration. As another example, the controller may execute method 400 at a predefined frequency or in response to engine maintenance being performed in order to update the calibrated acceleration window for each cylinder.

At 402, method 400 includes calibrating the crankshaft position sensor by collecting crank position data from the crank position sensor over a range of engine speeds and loads. For example, crank position data may be collected from the crank position sensor at a defined sampling rate. In one example, sensor output may be collected at approximately 8 MHz for the defined sample rate. On a 60-2 crank wheel, the 8 MHz sampling rate gives an accurate velocity of each tooth as it passes the crank position sensor with a resolution of 6 crank degrees. Further, crank position data may be collected as the engine speed and load are varied over a duration of the calibration procedure.

At 404, method 400 includes storing the crank position data as a function of engine speed and load for each cylinder. Further, the crank position data may be converted into tooth velocities by crank position processing low level drivers. The tooth velocities may change as the piston within each cylinder moves to/from top dead center (TDC) and bottom dead center (BDC), for example. Further still, the tooth velocities may be corrected to account for manufacturing variation in the crank wheel, such as via a correction algorithm.

At 406, method 400 includes identifying tooth periods having a highest velocity difference for each engine speed and load for each cylinder. For example, after converting the data into tooth velocities, the controller may analyze the crank position data for each engine speed-load set point that has the highest difference in velocity for a given cylinder. As an example, a tooth range of tooth 60 to tooth 105 may be identified for collection of crankshaft acceleration data. Herein, the calibration is performed for several data points (e.g., at least more than a threshold number of data points, such as nine data points) across the engine speed and load table. An example, calibration performed over nine engine speed load conditions is shown in FIG. 5.

At 408, method 400 includes storing an acceleration window for each cylinder as a function of engine speed and load based on the identified tooth periods having the highest velocity difference (e.g., as identified at 406). As one example, each acceleration window may correspond to a crank positon range during which an acceleration produced by combustion within the corresponding cylinder may be most accurately determined at the corresponding engine speed and load. As one example, the acceleration window for each cylinder may be stored in a look-up table indexed against engine speed and load. As such, the controller may later refer to the look-up table by inputting the engine speed and load to determine the calibrated acceleration window when monitoring for AFR imbalances (e.g., according to method 300 of FIGS. 3A-3B). Method 400 may then end.

In this way, in a four stroke cycle of a cylinder, the maximum tooth velocity and the minimum tooth velocity may be determined. For example, the maximum tooth velocity may occur at the end of a power stroke, and the minimum tooth velocity may occur at peak compression before the power stroke. The acceleration between the minimum tooth velocity and the maximum tooth velocity may be estimated as the crank acceleration produced by combustion within that cylinder. The crank acceleration determination process may be repeated for a plurality of speed-load conditions in order to identify windows for determining the crankshaft acceleration produced by each individual cylinder across engine operating conditions (e.g., calibrated acceleration windows).

Figure 5:
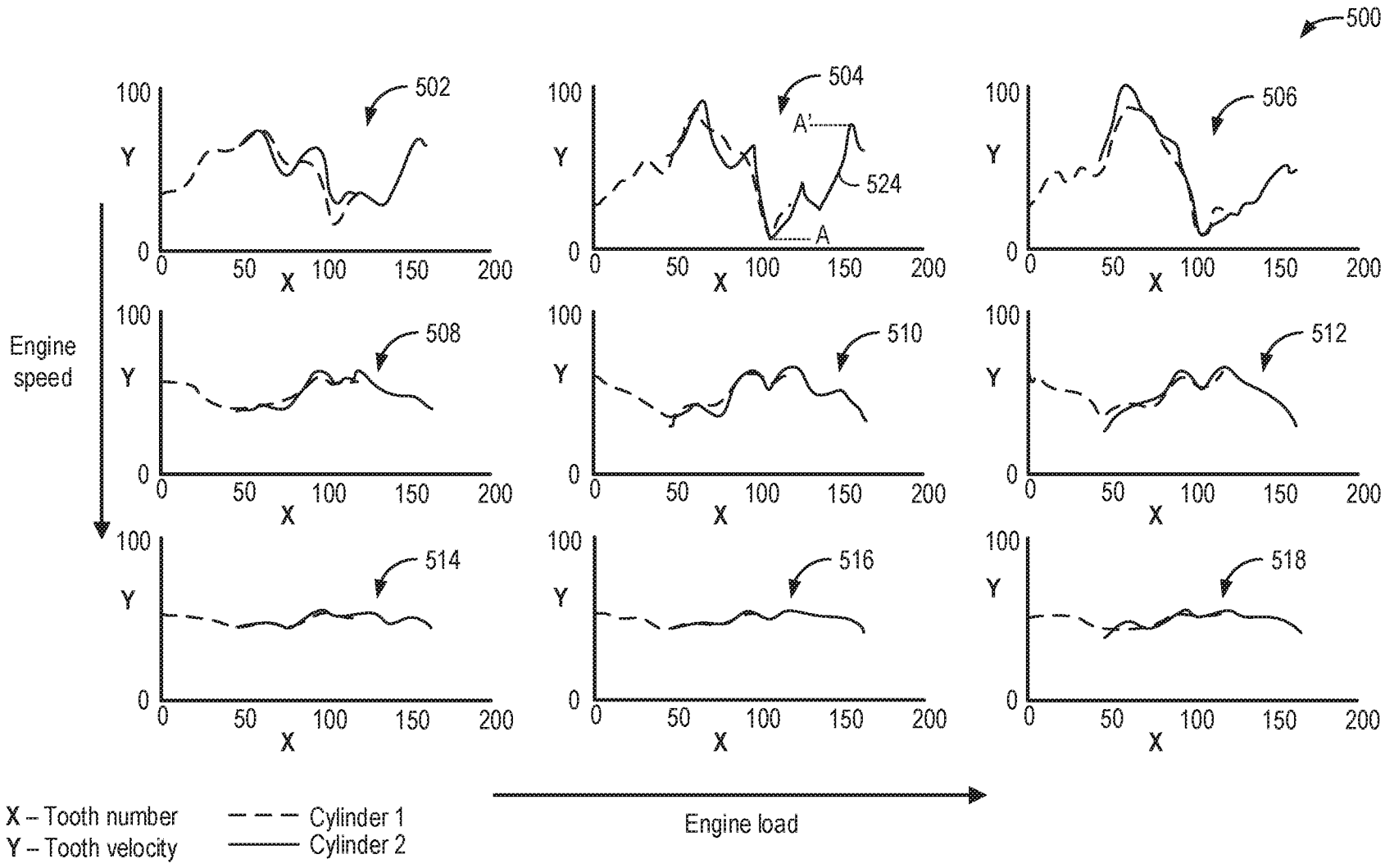
FIG. 5 shows plots for estimating cylinder accelerations at a plurality of engine speed-load conditions.

Turning now to FIG. 5, a map 500 for estimating cylinder accelerations at a plurality of engine speed-load conditions is shown. In particular, map 500 includes a first plot 502, a second plot 504, a third plot 506, a fourth plot 508, a fifth plot 510, a sixth plot 512, a seventh plot 514, an eighth plot 516, and a ninth plot 518, each plot including a different speed-load condition. For each plot, the X-axis denotes tooth number and the Y-axis denotes tooth velocity. The dashed line shows tooth velocity for a first cylinder (cylinder 1) while the solid line shows tooth velocity for a second cylinder (cylinder 2). The engine load is lowest for the first plot 502, the fourth plot 508, and the seventh plot 514, and the engine load is highest for the third plot 506, the sixth plot 512, and the ninth plot 518. Engine speed is lowest for the first plot 502, the second plot 504, and the third plot 506, and the engine speed in highest for the seventh plot 514, the eighth plot 516, and the ninth plot 518. The engine is operated in a mid-speed-load condition during generation of fifth plot 510.

For a given plot, cylinder acceleration may be estimated during the combustion stroke based on a difference in teeth velocity between a valley and a peak. As an example, for the second plot 504, cylinder acceleration for the second cylinder is estimated based on a difference between the points A and A' as shown on the plot 504, point A corresponding to the valley and point A' corresponding to a peak of the velocity curve 524. Thus, the tooth period would correspond to the tooth number at point A to the tooth number at point A' (e.g., from about 100 to about 160).

Next, FIG. 6 shows a first example sequence 600 for identifying and correcting a cylinder AFR imbalance in an engine system. For example, a controller (e.g., controller 12 of FIGS. 1 and 2) may execute a control routine, such as method 300 of FIGS. 3A-3B, to identify and correct the cylinder AFR imbalance. Sequence 600 schematically depicts sequential "snapshots" of controller assessments and engine parameter adjustments, including fuel amount and spark timing adjustments, at time t1, time t2, time t3, time t4, and time t5. Each representation of time (e.g., time t1, time t2, time t3, time t4, and time t5) may represent an instantaneous moment in time or a finite duration of time within sequence 600. The example of sequence 600 shows a four cylinder engine, although similar assessments and adjustments may be performed in multi-cylinder engines with other numbers of cylinders in order to identify and correct a cylinder AFR imbalances.

Beginning at time t1, the controller determines an individual crankshaft acceleration produced by each cylinder's combustion event and compares it to a mean acceleration, as depicted by a graph 602. Graph 602 includes cylinder number as the horizontal axis, with each cylinder number labeled, and crankshaft acceleration as the vertical axis, with crankshaft acceleration increasing along the vertical axis from bottom to top. Each data point represents the individual crankshaft acceleration produced by combustion in each cylinder (e.g., cylinder 1, cylinder 2, cylinder 3, or cylinder 4), which may be determined during a calibrated window for a current engine speed and load, as described above with respect to FIGS. 3A-3B, 4, and 5. Further, the controller determines a mean acceleration 604 for all of the cylinders and sets a first threshold range about the mean acceleration 604. The first threshold range is bounded by a first lower threshold 606 and a first upper threshold 608 (e.g., corresponding to the first threshold of FIG. 3A), the first lower threshold 606 a first threshold amount lower than the mean acceleration 604 and the first upper threshold 608 the first threshold amount greater than the mean acceleration 604.

In the example of graph 602, the individual crankshaft acceleration determined for cylinder 3 (depicted as an open circle) is greater than the first upper threshold 608. Therefore, the controller identifies cylinder 3 as having an AFR imbalance. Further, the controller may determine a difference 610 between the mean acceleration 604 and the crankshaft acceleration produced by cylinder 3. The controller may infer that cylinder 3 is richer than cylinders 1, 2, and 4 due to the higher-than-mean crankshaft acceleration produced by cylinder 3.

Proceeding to time t2, the controller references KAM arrays 612 of stored fuel multiplier values. Specifically, the controller selects one or more KAM arrays from the plurality of KAM arrays 612 based on whether or not the engine is operating with EGR and/or purge, as elaborated above with respect to FIGS. 3A-3B. Once selected, the controller inputs the difference 610, cylinder number, operating conditions, etc. into the one or more KAM arrays 612 to determine the fuel multiplier value, which is used to adjust fueling to cylinder 3 without adjusting base fueling to the engine.

Specifically, graph 614 at time t2 shows a fuel amount for each cylinder, with cylinder number as the horizontal axis (as labeled) and fuel amount as the vertical axis. The fuel amount increases along the vertical axis from bottom to top. Further, graph 614 includes a threshold fuel correction amount, bounded by a lower threshold fuel correction amount 616 and an upper fuel correction amount 618. As described above with respect to FIGS. 3A-3B, when the fuel multiplier value results in fuel amounts that are outside of the threshold fuel correction amount, degradation may be present. However, because the corrected fuel amount (e.g., determined based on the base fueling and the fuel multiplier value selected from the plurality of KAM arrays 612) is within the threshold fuel correction amount, the controller determines that degradation is not present. Due to the assumption that cylinder 3 is rich relative to the other cylinders of the engine, the fuel multiplier value decreases the cylinder 3 fuel amount relative to the other cylinders.

At time t3, the controller again evaluates the individual crankshaft acceleration produced by combustion in each cylinder, as shown in a graph 620. Graph 620 is similar to graph 602 shown at time t1; however, because the mean crankshaft acceleration changes as the individual crankshaft acceleration values change, the updated value is shown as mean acceleration 604'. Further, the controller sets a second threshold range about the mean acceleration 604', which is greater than the first threshold range at time t1 in the example of sequence 600. The second threshold range is bounded by a second lower threshold 622, which is a second threshold amount less than the mean acceleration 604', and a second upper threshold 624, which is the second threshold amount greater than the mean acceleration 604'. The crankshaft acceleration produced by cylinder 3 is within the second threshold from the mean acceleration 604' (e.g., is less than the second upper threshold 624 and greater than the second lower threshold 622) and has an updated difference 610' from the mean acceleration 604'.

In response to the fuel adjustment via the fuel multiplier bringing the crankshaft acceleration produced by cylinder 3 into the second threshold range, at time t4, the controller performs final balancing via spark adjustments. Specifically, the controller inputs the difference 610' into one or more spark timing look-up tables 626, which output the adjusted spark timing for cylinder 3. Graph 628 shows an amount of spark advance for each cylinder, with cylinder number along the horizontal axis (as labeled) and spark advance along the vertical axis. The amount of spark advance increases up the vertical axis toward MBT timing. Because the crankshaft acceleration produced by cylinder 3 is greater than the mean acceleration 604', the spark timing of cylinder 3 is further retarded from MBT timing (e.g., less advanced toward MBT timing).

At time t5, the controller again evaluates the crankshaft acceleration produced by combustion in each individual cylinder, as shown in a graph 630. Graph 630 is similar to graph 602 shown at time t1; however, because the mean crankshaft acceleration has again changed, the updated value is shown as mean acceleration 604". Further, the controller re-sets the first threshold range about the mean acceleration 604", shown as first lower threshold 606' and first upper threshold 608' because acceleration value of each threshold changes as the mean acceleration changes. The crankshaft acceleration produced by cylinder 3 is within the first threshold range, indicating that the AFR imbalance has been corrected via the fuel and spark adjustments.

In other examples, additional adjustments may be made before the imbalanced cylinder is considered corrected. Therefore, FIG. 7 shows a second example sequence 700 for identifying and correcting a cylinder AFR imbalance in an engine system. Similar to sequence 600 of FIG. 6, sequence 700 of FIG. 7 schematically depicts sequential "snapshots" of controller assessments and engine parameter adjustments at time t1, time t2, time t3, time t4, time t5, time t6, and time t7. Each representation of time (e.g., time t1, time t2, time t3, time t4, time t5, time t6, and time t7) may represent an instantaneous moment in time or a finite duration of time within sequence 700. The example of sequence 700 shows a four cylinder engine, although similar assessments and adjustments may be performed in multi-cylinder engines with other numbers of cylinders in order to identify and correct a cylinder AFR imbalance.

Beginning at time t1, the controller determines an individual crankshaft acceleration produced by each cylinder's combustion event and compares it to a mean acceleration, as depicted by a graph 702. Graph 702 includes cylinder number as the horizontal axis, with each cylinder number labeled, and crankshaft acceleration as the vertical axis, with crankshaft acceleration increasing along the vertical axis from bottom to top. Each data point represents the individual crankshaft acceleration produced by combustion in each cylinder (e.g., cylinder 1, cylinder 2, cylinder 3, or cylinder 4), which may be determined during a calibrated window for a current engine speed and load, as described above with respect to FIGS. 3A-3B, 4, and 5. Further, the controller determines a mean acceleration 704 for all of the cylinders and sets a first threshold range about the mean acceleration 704. The first threshold range is bounded by a first lower threshold 706 and a first upper threshold 708, the first lower threshold 706 a first threshold amount less than the mean acceleration 704 and the first upper threshold 708 the first threshold amount greater than the mean acceleration 704.

In the example of graph 702, the individual crankshaft acceleration determined for cylinder 4 (depicted as an open circle) is less than the first lower threshold 706. Therefore, the controller identifies cylinder 4 as having an AFR imbalance. Further, the controller may determine a difference 710 between the mean acceleration 704 and the crankshaft acceleration produced by cylinder 4. The controller may infer that cylinder 4 is leaner than cylinders 1, 2, and 3 due to the lower-than-mean crankshaft acceleration produced by cylinder 4.

Proceeding to time t2, the controller references KAM arrays 712 of stored fuel multiplier values. Specifically, the controller selects one or more KAM arrays from the plurality of KAM arrays 712 based on whether or not the engine is operating with EGR and/or purge, as elaborated above with respect to FIGS. 3A-3B. Once selected, the controller inputs the difference 710, the cylinder number, operating conditions, etc. into the one or more KAM arrays 712 to determine the fuel multiplier value, which is used to adjust fueling to cylinder 4 without adjusting base fueling to the engine.

Specifically, graph 714 at time t2 shows a fuel amount for each cylinder, with cylinder number as the horizontal axis (as labeled) and fuel amount as the vertical axis. The fuel amount increases along the vertical axis from bottom to top. Further, graph 714 includes a threshold fuel correction amount, bounded by a lower threshold fuel correction amount 716 and an upper fuel correction amount 718. As described above with respect to FIGS. 3A-3B, when the fuel multiplier value results in fuel amounts that are outside of the threshold fuel correction amount, degradation may be present. However, because the corrected fuel amount (e.g., determined based on the base fueling and the fuel multiplier value selected from the plurality of KAM arrays 712) is within the threshold fuel correction amount, the controller determines that degradation is not present. Further, due to the assumption that cylinder 4 is lean relative to the other cylinders of the engine, the fuel multiplier value increases the cylinder 4 fuel amount relative to the other cylinders.

At time t3, the controller again evaluates the individual crankshaft acceleration produced by combustion in each cylinder, as shown in a graph 720. Graph 720 is similar to graph 702 shown at time t1; however, because the mean crankshaft acceleration changes as the individual crankshaft acceleration values change, the updated value is shown as mean acceleration 704'. Further, the controller sets a second threshold range about the mean acceleration 704', which is greater than the first threshold range at time t1 in the example of sequence 700. The second threshold range is bounded by a second lower threshold 722, which is a second threshold amount less than the mean acceleration 704', and a second upper threshold 724, which is the second threshold amount greater than the mean acceleration 704'. The crankshaft acceleration produced by cylinder 4 is not within the second threshold from the mean acceleration 704' (e.g., is less than the second lower threshold 722) and has an update difference 710' from the mean acceleration 704'.

In response to the fuel adjustment via the fuel multiplier not correcting the AFR imbalance of cylinder 4, at time t4, the controller further adjusts the fuel amount delivered to cylinder 4. As shown in graph 726, which is similar to graph 714, the controller further increases the cylinder 4 fuel amount relative to the other cylinders. While the correct fuel amount approaches the upper fuel correction amount 718, it remains below the upper fuel correction amount 718, and degradation is not indicated.

At time t5, the controller re-evaluates the individual crankshaft acceleration produced by combustion in each cylinder, as shown in a graph 728. Graph 728 is similar to graph 720 shown at time t3 and includes a further updated mean acceleration 704" and a correspondingly adjusted second lower threshold 722' and second upper threshold 724'. At time t5, the crankshaft acceleration produced by cylinder 4 is within the second threshold from the mean acceleration 704" (e.g., is less than the second upper threshold 724' and greater than the second lower threshold 722') and has an update difference 710" from the mean acceleration 704". Therefore, the controller updates the KAM arrays 712" with the fuel multiplier value that has resulted in the crankshaft acceleration produced by cylinder 4 coming within the second threshold range.

At time t6, the controller performs final balancing via spark adjustments. Specifically, the controller inputs the difference 710" into one or more spark timing look-up tables 730, which output the adjusted spark timing for cylinder 4. Graph 732 shows an amount of spark advance for each cylinder, with cylinder number along the horizontal axis (as labeled) and spark advance along the vertical axis. The amount of spark advance increases up the vertical axis toward MBT timing. Because the crankshaft acceleration produced by cylinder 4 is less than the mean acceleration 704", the spark timing of cylinder 4 is further advanced toward MBT timing.

At time t7, the controller again evaluates the crankshaft acceleration produced by combustion in each individual cylinder, as shown in a graph 734. Graph 734 is similar to graph 702 shown at time t1; however, because the mean crankshaft acceleration has again changed, the updated value is shown as mean acceleration 704". Further, the controller re-sets the first threshold range about the mean acceleration 704''', shown as first lower threshold 706' and first upper threshold 708'. The crankshaft acceleration produced by cylinder 4 is within the first threshold range, indicating that the AFR imbalance has been corrected via the fuel and spark adjustments.

In this way, cylinder-to-cylinder AFR imbalances may be accurately identified non-intrusively using existing vehicle hardware, even while non-nominal imbalance sources (e.g., EGR and purge) are present. By using the mean crankshaft acceleration produced by all of the engine cylinders instead of absolute values, common mode conditions, such as increased friction or changes in fuel type, will not cause AFR imbalances to be incorrectly detected. Further, the AFR imbalances may be accurately corrected via crankshaft acceleration feedback in real-time until the AFR of each cylinder is balanced consistently across all cylinders of the engine. Furthermore, a combustion efficiency of the engine may be increased by generating heat in the cylinders rather than at a face of an exhaust catalyst due to oxygen from a lean-imbalanced cylinder combining with hydrocarbons from a rich-imbalanced cylinder. Further still, vehicle emissions may be reduced by identifying and correcting the cylinder AFR imbalance. By producing a uniform crankshaft acceleration from combustion in each cylinder, engine smoothness may be increased, thereby increasing vehicle occupant satisfaction.

The technical effect of comparing cylinder acceleration values for all engine cylinders to detect cylinder air-fuel ratio imbalances is that a robustness of the diagnostic method may be increased, even while exhaust gas recirculation and/or fuel vapor storage canister purging is occurring.

As one example, a method comprises: indicating an air-fuel ratio (AFR) imbalance of a cylinder of a multi-cylinder engine based on a first crankshaft acceleration produced by the cylinder relative to a first mean crankshaft acceleration produced by all cylinders of the engine; and in response to the AFR imbalance, adjusting a fuel amount of the cylinder via a fuel multiplier, the fuel multiplier selected from a plurality of fuel multipliers based on an imbalance source. In the preceding example, additionally or optionally, the imbalance source includes one or more imbalance sources selected from a plurality of imbalance sources, and the method additionally or optionally further comprises: isolating each imbalance source of the plurality of imbalance sources and independently learning the plurality of fuel multipliers for each of the plurality of imbalance sources. In one or both of the preceding examples, additionally or optionally, the plurality of imbalance sources includes nominal imbalance, purge imbalance, and exhaust gas recirculation (EGR) imbalance, and the method additionally or optionally further comprises: responsive to operating with more than one imbalance source, combining fuel multipliers from each of the more than one imbalance source. In any or all of the preceding examples, additionally or optionally, indicating the AFR imbalance of the cylinder based on the first crankshaft acceleration produced by the cylinder relative to the first mean crankshaft acceleration produced by all cylinders of the engine includes indicating the AFR imbalance of the cylinder responsive to the first crankshaft acceleration produced by the cylinder being greater than a first threshold difference from the first mean crankshaft acceleration. In any or all of the preceding examples, additionally or optionally, adjusting the fuel amount of the cylinder via the fuel multiplier includes decreasing the fuel amount of the cylinder responsive to the first crankshaft acceleration produced by the cylinder being at least the first threshold difference greater than the first mean crankshaft acceleration and increasing the fuel amount of the cylinder responsive to the first crankshaft acceleration produced by the cylinder being at least the first threshold difference less than the first mean crankshaft acceleration. In any or all of the preceding examples, the method additionally or optionally further comprises: after adjusting the fuel amount of the cylinder via the fuel multiplier, determining a second crankshaft acceleration produced by the cylinder relative to a second mean crankshaft acceleration produced by all cylinders of the engine, and responsive to the second crankshaft acceleration produced by the cylinder being greater than a second threshold difference from the second mean crankshaft acceleration, further adjusting the fuel amount of the cylinder by adjusting the fuel multiplier. In any or all of the preceding examples, the method additionally or optionally further comprises, responsive to the second crankshaft acceleration produced by the cylinder being less than the second threshold difference from the second mean crankshaft acceleration, adjusting spark timing of the cylinder. In any or all of the preceding examples, additionally or optionally, adjusting the spark timing of the cylinder includes advancing the spark timing of the cylinder toward maximum brake torque (MBT) timing responsive to the second crankshaft acceleration produced by the cylinder being less than the second mean crankshaft acceleration and retarding the spark timing of the cylinder from MBT timing responsive to the second crankshaft acceleration produced by the cylinder being greater than the second mean crankshaft acceleration. In any or all of the preceding examples, additionally or optionally, adjusting the spark timing of the cylinder includes adjusting the spark timing incrementally until a third crankshaft acceleration produced by the cylinder relative to a third mean crankshaft acceleration produced by all cylinders of the engine is less than the first threshold difference from the third mean crankshaft acceleration. In any or all of the preceding examples, additionally or optionally, adjusting the fuel amount of the cylinder via the fuel multiplier adjusts fueling to the cylinder without adjusting fueling to every cylinder of the multi-cylinder engine. In any or all of the preceding examples, additionally or optionally, the first crankshaft acceleration produced by the cylinder is determined based on crankshaft position sensor data received during an acceleration window, the acceleration window selected from a plurality of calibrated acceleration windows based on cylinder number, engine speed, and engine load.

As another example, a method comprises: isolating cylinder imbalance sources of a multi-cylinder engine and independently learning cylinder imbalance corrections for each of a plurality of imbalance sources; and combining the learned cylinder imbalance corrections responsive to cylinder imbalance detection while operating the engine with the plurality of imbalance sources together. In the preceding example, additionally or optionally, the plurality of imbalance sources includes purge imbalance and exhaust gas recirculation (EGR) imbalance, and operating the engine with the plurality of imbalance sources together includes operating the engine with a non-zero amount of EGR while purging stored fuel vapors from a fuel vapor storage canister to an intake of the engine. In one or both of the preceding examples, additionally or optionally, combining the learned cylinder imbalance corrections includes blending the learned cylinder imbalance corrections for the plurality of imbalance sources based on a percentage flow of EGR and a percentage flow of the stored fuel vapors. In any or all of the preceding examples, additionally or optionally, the plurality of imbalance sources further includes nominal imbalance, and the method further includes applying the learned cylinder imbalance corrections for the nominal imbalance responsive to the cylinder imbalance detection when operating the engine with zero EGR and without purging the stored fuel vapors from the fuel vapor storage canister. In any or all of the preceding examples, additionally or optionally, the cylinder imbalance detection includes: determining an individual crankshaft acceleration produced by each cylinder of the multi-cylinder engine and an average crankshaft acceleration produced across all cylinders of the multi-cylinder engine; and indicating the cylinder imbalance responsive to the individual crankshaft acceleration produced by one or more cylinders being greater than a threshold amount different than the average crankshaft acceleration.

As still another example, an engine system comprises: a plurality of cylinders coupled to a crankshaft; a crankshaft position sensor; and a controller with computer readable instructions stored on non-transitory memory that, when executed, cause the controller to: determine an acceleration of the crankshaft produced by a combustion event within each of the plurality of cylinders based on data received from the crankshaft position sensor; and responsive to one or more cylinders producing accelerations outside of a threshold range from a mean acceleration of the plurality of cylinders, adjust fueling of the one or more cylinders. In the preceding example, additionally or optionally, to adjust fueling of the one or more cylinders, the controller includes further instructions in non-transitory memory that, when executed, cause the controller to: select a fuel multiplier value for each of the one or more cylinders from a plurality of fuel multiplier values stored in memory based on engine speed and load, a cylinder number of the one or more cylinders, and an imbalance source; and adjust a pulse width of fuel delivered to each of the one or more cylinders via the selected fuel multiplier value. In one or both of the preceding examples, the system further comprises: an exhaust gas recirculation (EGR) passage coupled between an exhaust passage of the engine and an intake passage of the engine, the EGR passage include an EGR valve disposed therein; and an evaporative emissions system including a fuel vapor storage canister coupled to a fuel tank, the fuel vapor storage canister coupled to the intake passage of the engine via a purge line with a canister purge valve disposed therein. In any or all of the preceding examples, additionally or optionally, the imbalance source includes one or more of a plurality of potential imbalance sources, the plurality of potential imbalance sources including nominal air flow, EGR flow, and purge flow, and wherein the controller includes further instructions stored in non-transitory memory that, when executed, cause the controller to: determine the imbalance source from the plurality of potential imbalance sources based on a position of the EGR valve and a position of the canister purge valve; and after adjusting fueling of the one or more cylinders, adjusting spark timing of the one or more cylinders until the one or more cylinders produce accelerations inside of the threshold range from the mean acceleration of the plurality of cylinders.

In another representation, a method comprises: determining a crankshaft acceleration produced by each individual cylinder of a multi-cylinder engine; identifying an air-fuel ratio imbalance of a first cylinder responsive to a first crankshaft acceleration produced by the first cylinder being greater than a first threshold from a first mean acceleration produced by all cylinders of the multi-cylinder engine; and in response to the AFR imbalance of the first cylinder, adjusting fueling to the first cylinder via a fuel multiplier determined based on an imbalance source of the AFR imbalance. In the preceding example, additionally or optionally, determining the crankshaft acceleration produced by each individual cylinder of the multi-cylinder engine includes determining the crankshaft acceleration based on data received from a crankshaft position sensor during a pre-calibrated crankshaft position window for each cylinder, the pre-calibrated crankshaft position window selected from a plurality of pre-calibrated crankshaft position windows based on engine speed and load. In one or both of the preceding examples, additionally or optionally, the imbalance source includes one or more of nominal imbalance, purge imbalance, and exhaust gas recirculation (EGR) imbalance, the imbalance source determined based on intake flow sources provided to the multi-cylinder engine. In any or all of the preceding examples, additionally or optionally, the intake flow source includes fresh air only for the nominal imbalance; the intake flow source includes recirculated exhaust gas for the EGR imbalance; and the intake flow source includes fuel vapors purged from a fuel vapor storage canister for the purge imbalance. In any or all of the preceding examples, additionally or optionally, the fuel multiplier decreases fueling to the first cylinder responsive to the first crankshaft acceleration being at least the first threshold amount greater than the first mean acceleration; and the fuel multiplier increases fueling to the first cylinder responsive to the first crankshaft acceleration being at least the first threshold amount less than the first mean acceleration. In any or all of the preceding examples, the method additionally or optionally further comprises, after adjusting fueling to the first cylinder via the fuel multiplier, determining a second crankshaft acceleration produced by the first cylinder and a second mean crankshaft acceleration produced by all cylinders of the multi-cylinder engine, and responsive to the second crankshaft acceleration produced by the first cylinder being greater than a second threshold difference from the second mean crankshaft acceleration, further adjusting the fuel amount of the cylinder by adjusting the fuel multiplier. In any or all of the preceding examples, the method additionally or optionally further comprises, returning the first cylinder to a base fueling amount and indicating degradation responsive to the fuel multiplier exceeding a threshold.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

detecting multiple cylinder imbalance sources;

in response to detecting the multiple cylinder imbalance sources, isolating cylinder imbalance sources of a multi-cylinder engine;

learning independent cylinder imbalance corrections for each of the multiple imbalance sources occurring at differing conditions of one or more of exhaust gas recirculation (EGR) and fuel vapor purge; and operating the engine with multiple of the plurality of imbalance sources occurring by blending multiple of the independent cylinder imbalance corrections based on a percentage of a total gas flow corresponding to each of the multiple of the plurality of imbalance sources.

2. The method of claim 1, wherein the plurality of imbalance sources includes purge imbalance and EGR imbalance, and operating the engine with the plurality of imbalance sources together includes operating the engine with a non-zero amount of EGR while purging stored fuel vapors from a fuel vapor storage canister to an intake of the engine.

3. The method of claim 2, wherein the blending of multiple of the independent cylinder imbalance corrections comprises blending a correction value for the EGR imbalance based on a percentage of the total gas flow that is EGR flow with a correction value for the purge imbalance based on a percentage of the total gas flow that is purge gas flow.

4. The method of claim 2, wherein the plurality of imbalance sources further includes nominal imbalance, and the method further includes applying the learned cylinder imbalance corrections for the nominal imbalance responsive to the cylinder imbalance detection when operating the engine with zero EGR and without purging the stored fuel vapors from the fuel vapor storage canister.

5. The method of claim 1, wherein the cylinder imbalance detection includes:

determining a crankshaft acceleration for a cylinder of the multi-cylinder engine and an average crankshaft acceleration produced across all cylinders of the multi-cylinder engine; and indicating the cylinder imbalance responsive to the individual crankshaft acceleration produced by one or more cylinders being greater than a threshold amount different than the average crankshaft acceleration.

6. The method of claim 5, wherein the independent cylinder imbalance corrections are fuel amount corrections, and further comprising:

after performing the fuel amount corrections, determining second crankshaft accelerations relative to a second mean crankshaft acceleration produced by all cylinders of the engine, and responsive to one or more of the second crankshaft accelerations being greater than a second threshold difference from the second mean crankshaft acceleration, further adjusting the fuel amount.

7. The method of claim 6, further comprising, responsive to one or more of the crankshaft accelerations being less than the second threshold difference from the mean crankshaft acceleration, adjusting spark timing of the cylinder.

8. The method of claim 7, wherein adjusting the spark timing of the cylinder includes advancing the spark timing of the cylinder toward maximum brake torque (MBT) timing responsive to the crankshaft acceleration being less than the mean crankshaft acceleration and retarding the spark timing of the cylinder from MBT timing responsive to the crankshaft acceleration produced by the cylinder being greater than the mean crankshaft acceleration.

9. The method of claim 7, wherein adjusting the spark timing of the cylinder includes adjusting the spark timing incrementally until a second crankshaft acceleration relative to a second mean crankshaft acceleration produced by all cylinders of the engine is less than the threshold difference from the second mean crankshaft acceleration.

* * * * *